US005965322A

United States Patent [19]

Makuta et al.

[11] Patent Number: 5,965,322

[45] Date of Patent: Oct. 12, 1999

[54] SILVER HALIDE COLOR PHOTOGRAPHIC LIGHT-SENSITIVE MATERIAL

[75] Inventors: Toshiyuki Makuta; Koki Nakamura; Kiyoshi Takeuchi, all of Minami-ashigara, Japan

[73] Assignee: Fuji Photo Film Co., Ltd., Kanagawa-ken, Japan

[21] Appl. No.: 08/802,437

[22] Filed: Feb. 18, 1997

[30] Foreign Application Priority Data

Feb. 20, 1996 [JP] Japan ..... 8-055382

[51] Int. Cl.[6] ..... G03C 1/06

[52] U.S. Cl. ..... 430/264; 430/598; 430/551; 430/552; 430/553; 430/505; 430/379; 430/407; 430/409; 430/410

[58] Field of Search ..... 430/264, 598, 430/551, 552, 553, 505, 379, 407, 409, 410

[56] References Cited

U.S. PATENT DOCUMENTS

| | | | |
|---|---|---|---|
| 2,507,114 | 5/1950 | McQueen | 260/509 |
| 3,764,328 | 10/1973 | Birkeland | 96/67 |
| 4,060,418 | 11/1977 | Waxman et al. | 430/212 |
| 5,447,835 | 9/1995 | Sakai et al. | 430/598 |
| 5,604,089 | 2/1997 | Ikegawa et al. | 430/598 |
| 5,683,853 | 11/1997 | Makuta et al. | 430/264 |
| 5,780,198 | 7/1998 | Goto et al. | 430/598 |

FOREIGN PATENT DOCUMENTS

| | | |
|---|---|---|
| 0545491 | 6/1993 | European Pat. Off. . |
| 0565165 | 10/1993 | European Pat. Off. . |

*Primary Examiner*—Geraldine Letscher
*Attorney, Agent, or Firm*—Sughrue, Mion, Zinn, Macpeak & Seas, PLLC

[57] ABSTRACT

There is disclosed a silver halide color photographic light-sensitive material that contains, in photographic constitutional layers on a support, a hydrazine-series reducing agent for color formation, and a phenol-series magenta coupler having an acylamino group at the 5-position, and/or a naphthol-series cyan coupler having an amido group at the 5-position. The light-sensitive material makes low-replenishment and low-discharge processing possible, and exhibits good color reproducibility and good color-forming property.

25 Claims, No Drawings

SILVER HALIDE COLOR PHOTOGRAPHIC LIGHT-SENSITIVE MATERIAL

FIELD OF THE INVENTION

The present invention relates to an image-forming technique for use in color photography. In particular, the present invention relates to a silver halide color photographic light-sensitive material that is excellent from the standpoint of environmental protection and safety; that shows good color-forming property and hue with convenient and rapid processing; and further the present invention relates to a method of forming a color image.

BACKGROUND OF THE INVENTION

In a general color photographic light-sensitive material, when the said light-sensitive material is exposed to light image-wise and then color-developed, the oxidized p-phenylenediamine derivative reacts with couplers to form an image. In this system, color reproduction by the subtractive color technique is used, and, to reproduce blue, green, and red colors, couplers that form dye images of yellow, magenta, and cyan in color, respectively complementary to blue, green, and red, are used.

Conventional color development is achieved by immersing a light-exposed color photographic light-sensitive material in an aqueous alkali solution having a p-phenylenediamine derivative dissolved therein (a color developer). However, there is a problem that the p-phenylenediamine derivative in an aqueous alkali solution is unstable and is apt to deteriorate over time, and in order to retain stable development performance, the color developer must be replenished frequently. Further, the disposal of used color developers containing a p-phenylenediamine derivative is burdensome, and together with the above frequent replenishment, the treatment of used color developers discharged in large quantities gives rise to a serious problem. Thus, there is a strong demand for the attainment of low replenishment and reduced discharge of color developers.

One effective measure proposed for attaining low replenishment and reduced discharge of color developers is a method wherein an aromatic primary amine developing agent or its precursor is built in a hydrophilic colloid layer of a light-sensitive material, and examples of the aromatic primary amine developing agents or their precursors that can be built in include compounds described, for example, in U.S. Pat. Nos. 2,507,114, 3,764,328, and 4,060,418, and JP-A ("JP-A" means unexamined published Japanese patent application) Nos. 6235/1981 and 192031/1983. However, since these aromatic primary amines and their precursors are unstable, there is the defect that, when the unprocessed light-sensitive material is stored for a long period of time or is color-developed, stain occurs. Another effective measure proposed is a method wherein a sulfonylhydrazine-type compound, as described, for example, in European Patent Nos. 0,545,491A1 and 0,565,165A1, is built in a hydrophilic colloid layer of a light-sensitive material. When a conventional phenol coupler is used, however, there is a problem that the color formability is low, and therefore the development of a technique to improve the color-forming property is desired. On the other hand, when a conventional naphthol coupler is used, although a good color-forming property is exhibited, there is a problem that the absorption wavelength of the resulting cyan dye is too short and satisfactory color reproduction cannot be obtained. To solve this problem, the development of a technique to shift the absorption wavelength of the formed cyan dyes to a longer wavelength region is desired.

SUMMARY OF THE INVENTION

An object of the present invention is to provide a silver halide color light-sensitive material that makes low-replenishment and low-discharge processing possible, that exhibits good color reproduction, and that is good in color-forming property.

Other and further objects, features, and advantages of the invention will appear more fully from the following description.

DETAILED DESCRIPTION OF THE INVENTION

The present inventors have found that the foregoing object of the present invention can be attained by the following means.

(1) A silver halide color photographic light-sensitive material having at least one photographic constitutional layer including at least one light-sensitive silver halide emulsion layer on a support, wherein in the same or different photographic constitutional layers are contained at least one reducing agent for color formation represented by the following formula (I), and at least one dye-forming coupler represented by the following formula (II):

$$R^{11}—NH—NH—X—R^{12} \qquad \text{Formula (I)}$$

wherein, in formula (I), $R^{11}$ represents an aryl group or a heterocyclic group; $R^{12}$ represents an alkyl group, an alkenyl group, an alkynyl group, an aryl group, or a heterocyclic group; and X represents a group selected from the group consisting of $—SO_2—$, —CO—, —COCO—, —CO—O—, —CO—N($R^{13}$)—, —COCO—O—, —COCO—N($R^{13}$)—, and $—SO_2—N(R^{13})—$, in which $R^{13}$ represents a hydrogen atom or a group mentioned for $R^{12}$, Formula (II)

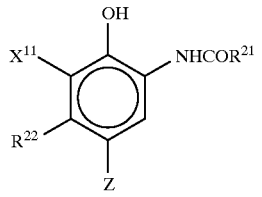

wherein, in formula (II), $R^{21}$ represents an aliphatic group, an aromatic group, a heterocyclic group, an aromatic amino group, or a heterocyclic amino group; $R^{22}$ represents an acylamino group; $X^{11}$ represents a hydrogen atom, a halogen atom, or an aliphatic group, an aromatic group, or an acylamino group; Z represents a hydrogen atom or a group capable of being split off upon oxidation coupling with a reducing agent for color formation; $R^{22}$ and $X^{11}$ may bond together to form a 5- to 7-membered nitrogen-containing heterocyclic ring; and one of $R^{21}$, $R^{22}$, $X^{11}$, and Z may serve to form a dimer coupler or a higher polymer coupler.

(2) A silver halide color photographic light-sensitive material having at least one photographic constitutional layer including at least one light-sensitive silver halide emulsion layer on a support, wherein in the same or different photographic constitutional layers are contained at least one reducing agent for color formation represented by the above formula (I), and at least one dye-forming coupler represented by the following formula (III):

Formula (III)

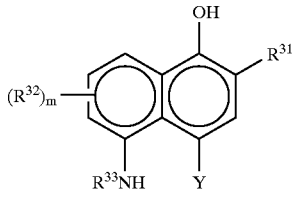

wherein, in formula (III), $R^{31}$ represents —$CONR^{34}R^{35}$, —$NHCOR^{34}$, —$NHCOOR^{36}$, —$NHSO_2R^{36}$, or —$NHCONR^{34}R^{35}$, in which $R^{34}$ and $R^{35}$, which are the same or different, each independently represent a hydrogen atom, an aliphatic group, an aromatic group, or a heterocyclic group; and $R^{36}$ represents an aliphatic group, an aromatic group, or a heterocyclic group; $R^{32}$ represents a group substitutable onto a naphthol ring; m is an integer of 0 to 3; $R^{33}$ represents an acyl group or an oxycarbonyl group; and Y represents a hydrogen atom or a group capable of being split off upon oxidation coupling with a reducing agent for color formation, and when m is 2 or 3, $R^{32}$s may be the same or different, or they may bond together to form a condensed ring; and $R^{32}$ and $R^{33}$, or $R^{33}$ and Y, may bond together to form a ring.

When a phenol coupler is used in combination with a reducing agent for color formation for use in the present invention, a magenta-tinged color image is obtained, while when a naphthol coupler is used in combination with a reducing agent for color formation for use in the present invention, a cyan-tinged color image is obtained. However, color images obtained from conventional phenol couplers and/or naphthol couplers are not satisfactory in view of the color-forming property and the color reproducibility. As a result of intensive investigations, the inventors of the present invention have found that, out of phenol couplers, a phenol coupler represented by formula (II), and out of naphthol couplers, a naphthol coupler represented by formula (III), give, respectively, a magenta color image and a cyan color image that exhibit good color-forming property and good color reproducibility.

In view of color-forming property, the reducing agent for color formation for use in the present invention is preferably a compound represented by formula (IV-a), and more preferably a compound represented by formula (V).

Further, a compound represented by formula (IV-b) is preferable, in that it is high in color-forming property; a two-equivalent coupler can be used as a corresponding coupler, and the increase in stain that will occur when the unprocessed light-sensitive material is stored for a long period of time is particularly small.

$R^{11}$—NHNH—$X^{11}$—$R^{12}$ Formula (IV-b)

wherein, in formula (IV-b), $X^{11}$ represents —CO— or —$CON(R^{13})$—; and $R^{11}$, $R^{12}$ and $R^{13}$ each have the same meanings as defined in formula (I).

In formula (IV-b), $R^{11}$ preferably represents a substituted phenyl group or a 5-membered or 6-membered heterocyclic group containing at least one nitrogen atom (to this heterocyclic group another ring, e.g. a benzene ring, may be condensed; and, in the heterocyclic group other hetero atoms, e.g. a sulfur atom, may be contained in addition to the nitrogen atom). Examples of the substituted phenyl group are those selected from

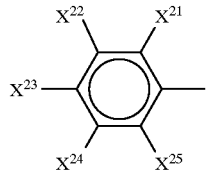

in formula (V) shown below.

Further, $R^{12}$ in formula (IV-b) preferably represents an aryl group (particularly a substituted phenyl group), an alkyl group (a substituted or unsubstituted alkyl group), or a cycloalkyl group (e.g. a cyclohexyl group). Examples of the substituent on these groups are substituents that are known as substituents on these groups, e.g. an alkyl group, an alkenyl group, and an aryl group. $R^{13}$ is preferably a hydrogen atom.

$R^{11}$—NH—NH—$SO_2$—$R^{12}$ Formula (IV-a)

wherein, in formula (IV-a), $R^{11}$ represents an aryl group or a heterocyclic group, and $R^{12}$ represents an alkyl group, an alkenyl group, an alkynyl group, an aryl group, or a heterocyclic group.

Formula (V)

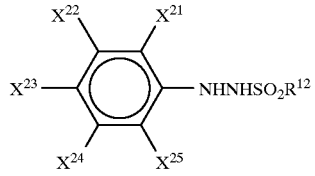

wherein, in formula (V), $R^{12}$ represents an alkyl group or a heterocyclic group; $X^{21}$, $X^{23}$, and $X^{25}$ each represent a hydrogen atom, a nitro group, a cyano group, an alkylsulfonyl group, an arylsulfonyl group, an alkylsulfinyl group, an arylsulfinyl group, a sulfamoyl group, a carbamoyl group, an alkoxycarbonyl group, an aryloxycabonyl group, an acyl group, or a trifluoromethyl group; and $X^{22}$ and $X^{24}$ each represent a hydrogen atom, a nitro group, a cyano group, an alkylsulfonyl group, an arylsulfonyl group, an alkylsulfinyl group, an arylsulfinyl group, a sulfamoyl group, a carbamoyl group, an alkoxycarbonyl group, an aryloxycarbonyl group, an acyl group, a trifluoromethyl group, a halogen atom, an acyloxy group, or an acylthio group, with the proviso that the sum of the Hammett $\sigma_p$ values of $X^{21}$, $X^{23}$, and $X^{25}$, and the Hammett $\sigma_m$ values of $X^{22}$ and $X^{24}$, must be 1.5 or more.

In formulae (I), (IV-a), (IV-b), and (V), each of $R^{11}$ and $R^{12}$ may be substituted. In the present invention, $R^{11}$ and $R^{12}$ include both substituted groups and unsubstituted ones.

According to the present invention, by using a combination of an open-chain methylene-type yellow coupler, a magenta coupler represented by formula (II), and a cyan coupler represented by formula (III), three colors: yellow, magenta, and cyan, can be formed with good color reproducibility and color-forming property. According to the present invention, it has become possible to provide a full-color light-sensitive material.

Now, the color-forming reducing agent to be used in the present invention will be described in detail.

The color-forming reducing agent represented by formula (I) to be used in the present invention is a compound characterized in that the compound is oxidized by undergoing oxidation reaction in an alkaline solution directly or indirectly with a developing agent oxidized with a silver halide that has been exposed to light, and its oxidation product further reacts with a dye-forming coupler, to form a dye.

In formula (I), $R^{11}$ represents an aryl group or a heterocyclic group, which may be substituted. The aryl group represented by $R^{11}$ has preferably 6 to 14 carbon atoms, and examples are phenyl and naphthyl. The heterocyclic group represented by $R^{11}$ is preferably a saturated or unsaturated, 5-membered, 6-membered, or 7-membered heterocyclic ring containing at least one of nitrogen, oxygen, sulfur, and selenium, to which a benzene ring or a heterocyclic ring may be condensed. Examples of the heterocyclic ring represented by $R^{11}$ are furanyl, thienyl, oxazolyl, thiazolyl, imidazolyl, triazolyl, pyrrolidinyl, benzoxazolyl, benzthiazolyl, pyridyl, pyridazyl, pyrimidinyl, pyrazinyl, triazinyl, quinolinyl, isoquinolinyl, phthalazinyl, quinoxalinyl, quinazolinyl, purinyl, pteridinyl, azepinyl, and benzooxepinyl.

The substituent possessed by $R^{11}$ includes, for example, an alkyl group, an alkenyl group, an alkynyl group, an aryl group, a heterocyclic group, an alkoxy group, an aryloxy group, a heterocyclic oxy group, an alkylthio group, an arylthio group, a heterocyclic thio group, an acyloxy group, an acylthio group, an alkoxycarbonyloxy group, an aryloxycarbonyloxy group, a carbamoyloxy group, an alkylsulfonyloxy group, an arylsulfonyloxy group, an amino group, an alkylamino group, an arylamino group, an amido group, an alkoxycarbonylamino group, an aryloxycarbonylamino group, a ureido group, a sulfonamido group, a sulfamoylamino group, an acyl group, an alkoxycarbonyl group, an aryloxycarbonyl group, a carbamoyl group, an acylcarbamoyl group, a carbamoylcarbamoyl group, a sulfonylcarbamoyl group, a sulfamoylcarbamoyl group, an alkylsulfonyl group, an arylsulfonyl group, an alkylsulfinyl group, an arylsulfinyl group, an alkoxysulfonyl group, an aryloxysulfonyl group, a sulfamoyl group, an acylsulfamoyl group, a carbamoylsulfamoyl group, a halogen atom, a nitro group, a cyano group, a carboxyl group, a sulfo group, a phosphono group, a hydroxyl group, a mercapto group, an imido group, and an azo group.

$R^{12}$ represents an alkyl group, an alkenyl group, an alkynyl group, an aryl group, or a heterocyclic group, which may be substituted.

The alkyl group represented by $R^{12}$ is a straight-chain, branched, or cyclic alkyl group having preferably 1 to 16 carbon atoms, such as methyl, ethyl, hexyl, dodecyl, 2-octyl, t-butyl, cyclopentyl, and cylooctyl. The akenyl group represented by $R^{12}$ is a chain or cyclic alkenyl group having preferably 2 to 16 carbon atoms, such as vinyl, 1-octenyl, and cyclohexenyl.

The alkynyl group represented by $R^{12}$ is an alkynyl group having preferably 2 to 16 carbon atoms, such as 1-butynyl and phenylethynyl. The aryl group and the heterocyclic group represented by $R^{12}$ include those mentioned for $R^{11}$. The substituent possessed by $R^{12}$ includes those mentioned for the substituent of $R^{11}$.

X is preferably —$SO_2$—, —CO—, —COCO—, or —CON($R^{13}$)—, and in view of color-forming property, more preferably X is —$SO_2$— or —CON($R^{13}$)—. Among others, particularly preferably X is —CON($R^{13}$)—, because a two-equivalent coupler can be used as a corresponding coupler, and the increase in stain that is apt to occur when the unprocessed light-sensitive material is stored for a long period of time is small.

Further, preferably $R^{11}$ is a nitrogen-containing heterocyclic group or a group represented by formula (VI), and more preferably it is a 6-membered nitrogen-containing heterocyclic group or a group represented by formula (VI). When X is —$SO_2$—, particularly preferably $R^{11}$ is a group represented by formula (VI), in view of the color-forming property.

Formula (VI)

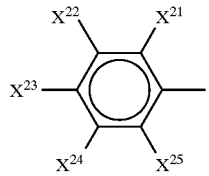

wherein $X^{21}$, $X^{23}$, and $X^{25}$ each represent a hydrogen atom, a nitro group, a cyano group, an alkylsulfonyl group, an arylsulfonyl group, an alkylsulfinyl group, an arylsulfinyl group, a sulfamoyl group, a carbamoyl group, an alkoxycarbonyl group, an aryloxycarbonyl group, an acyl group, or a trifluoromethyl group, and $X^{22}$ and $X^{24}$ each represent a hydrogen atom, a nitro group, a cyano group, an alkylsulfonyl group, an arylsulfonyl group, an alkylsulfinyl group, an arylsulfinyl group, a sulfamoyl group, a carbamoyl group, an alkoxycarbonyl group, an aryloxycarbonyl group, an acyl group, a trifluoromethyl group, a halogen atom, an acyloxy group, or an acylthio group, with the proviso that the sum total of the Hammett $\sigma_p$ values of $X^{21}$, $X^{23}$, and $X^{25}$, and the Hammett $\sigma_m$ values of $X^{22}$ and $X^{24}$ must be 1.5 or more.

The reducing agent for color formation for use in the present invention is preferably one that is non-diffusible in emulsion layers.

Specific examples of compounds of the formula (I) are shown below:

I-1
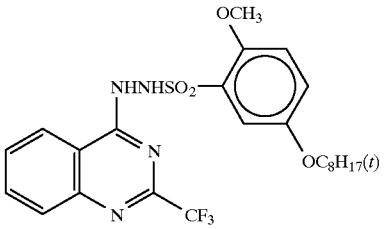
I-2
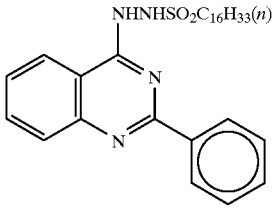
I-3
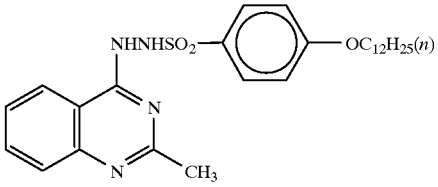
I-4
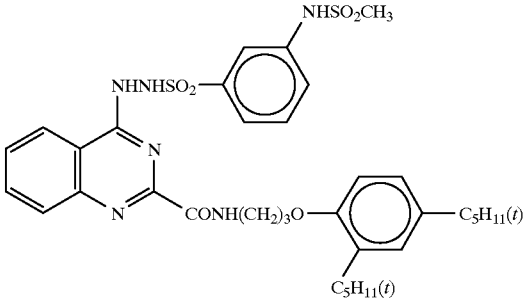
I-5
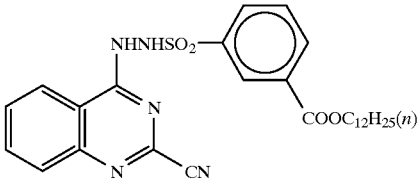
I-6
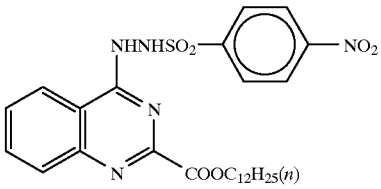
I-7
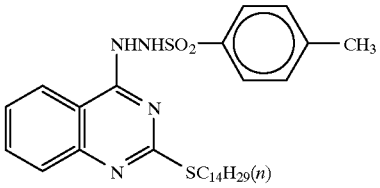
I-8
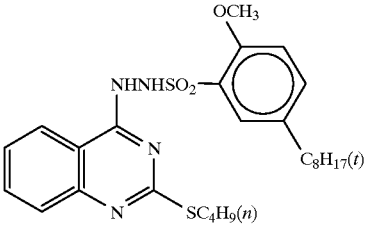
I-9
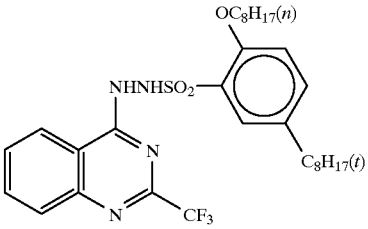
I-10
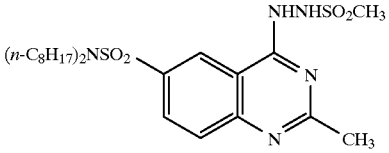
I-11
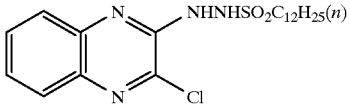
I-12
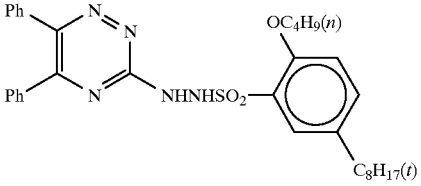

-continued
I-13
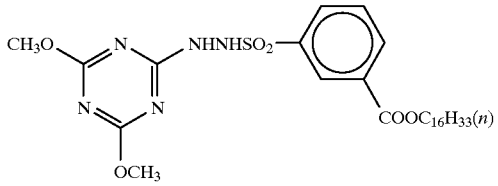
I-14
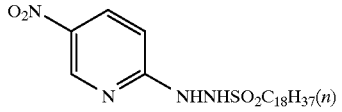
I-15
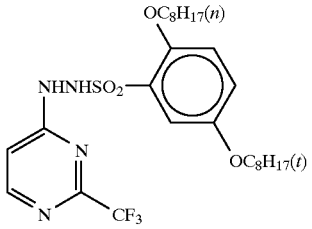
I-16
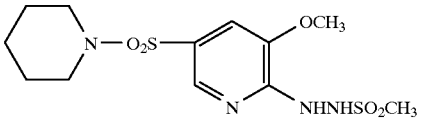
I-17
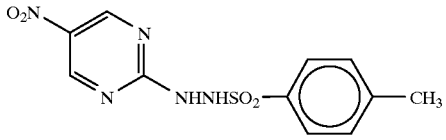
I-18
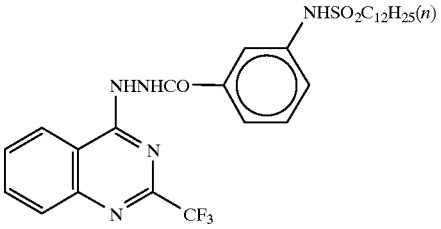
I-19
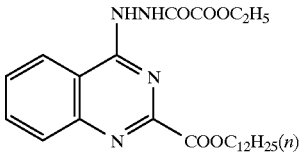
I-20
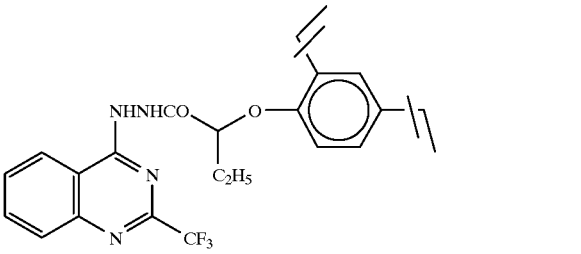
I-21
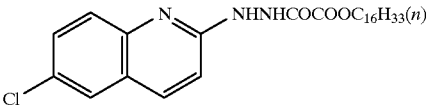
I-22
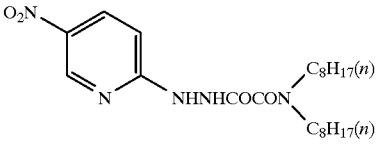
I-23
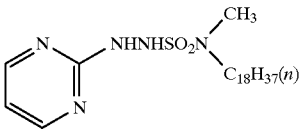

-continued
I-24
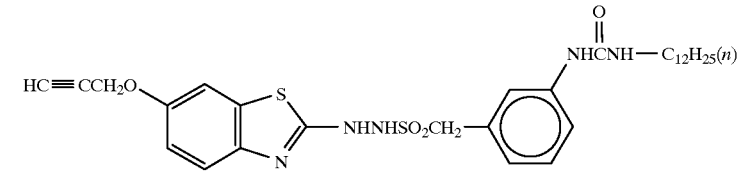
I-25
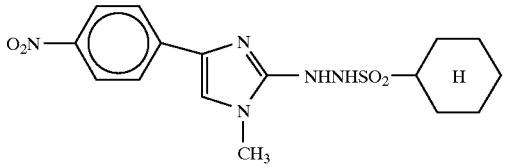
I-26
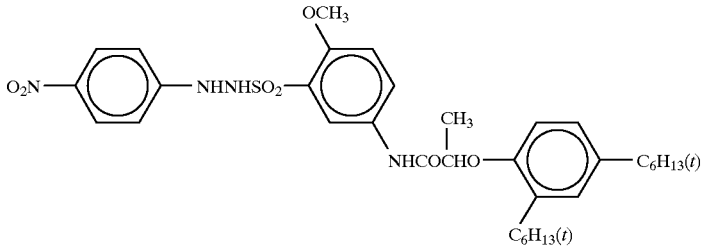
I-27
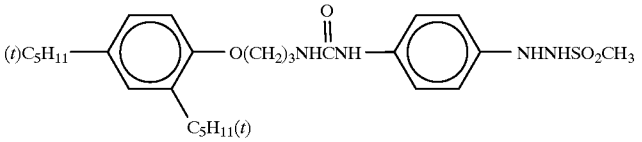
I-28
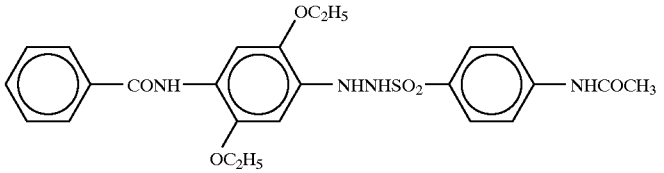
I-29
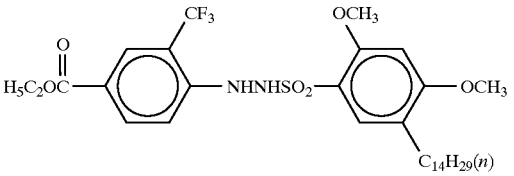
I-30
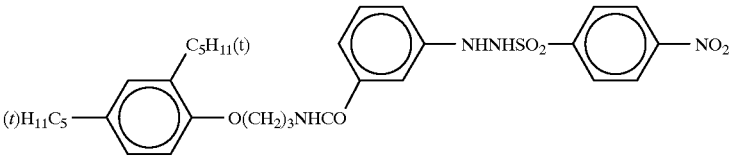

-continued
I-31
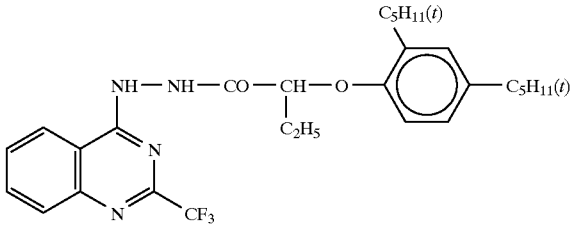
I-32
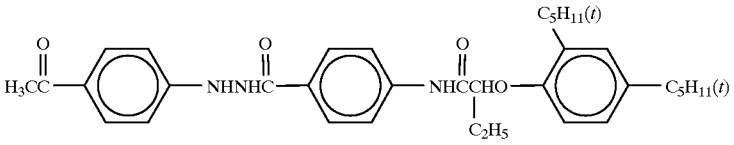
I-33
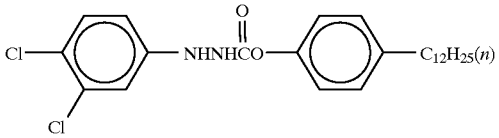
I-34
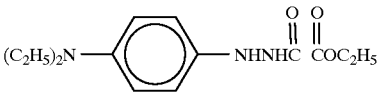
I-35
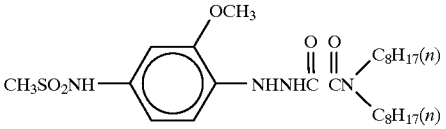
I-36
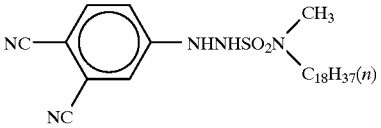
I-37
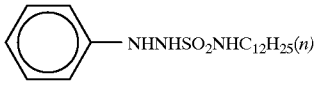
I-38
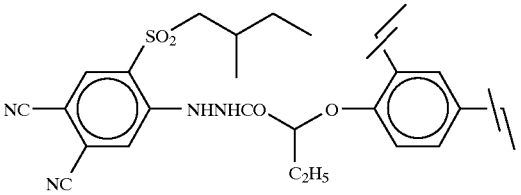
I-39
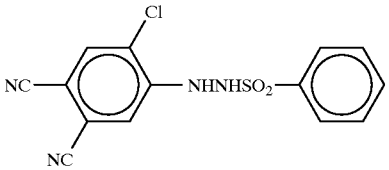
I-40
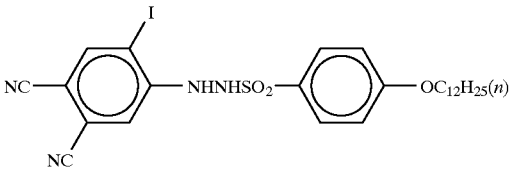
I-41
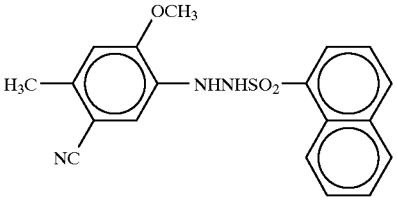
I-42
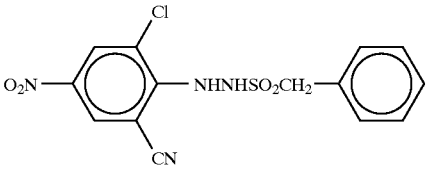

-continued
I-43
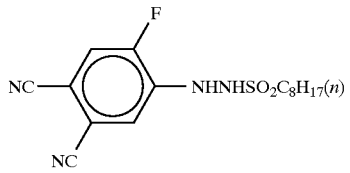
I-44
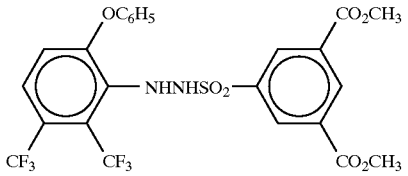
I-45
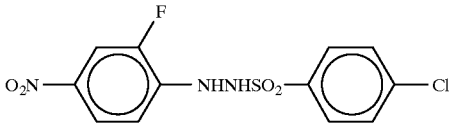
I-46
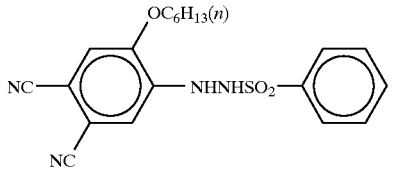
I-47
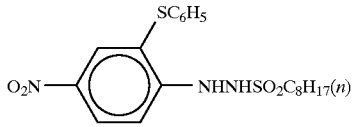
I-48
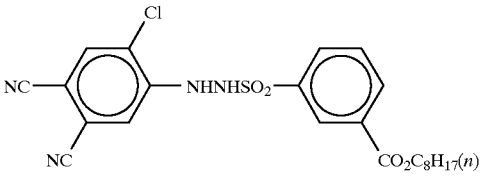
I-49
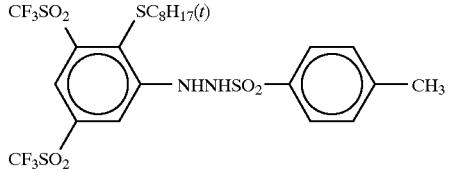
I-50
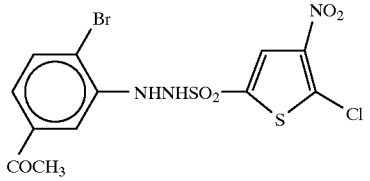
I-51
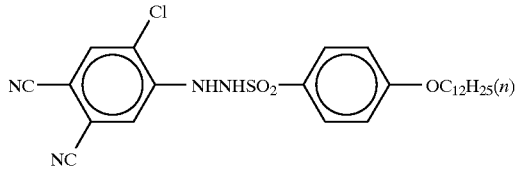
I-52
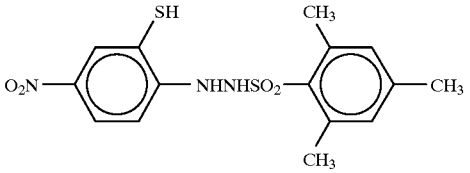
I-53
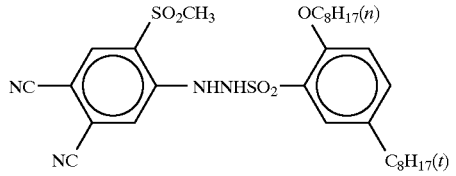
I-54
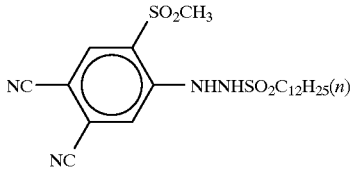
I-55
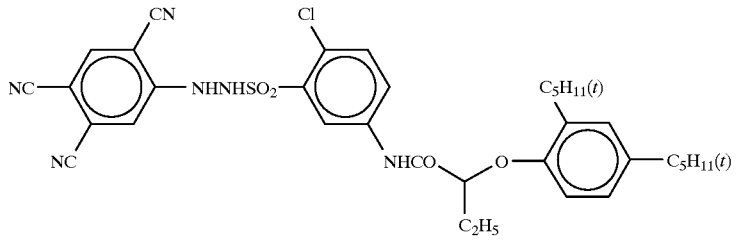

-continued
I-56
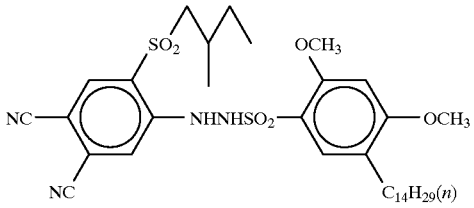
I-57
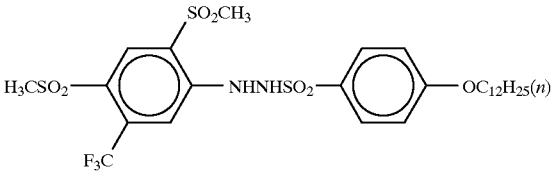
I-58
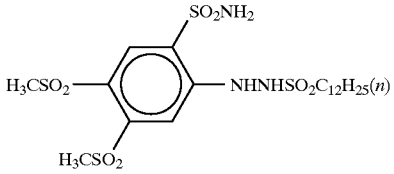
I-59
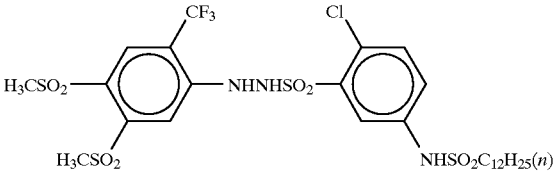
I-60
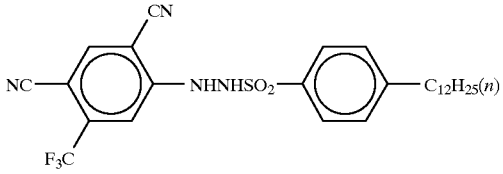
I-61
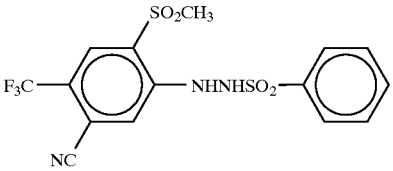
I-62
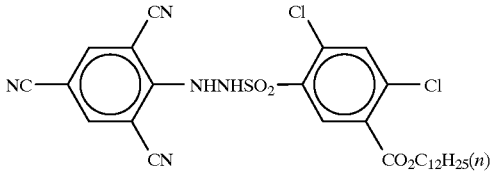
I-63
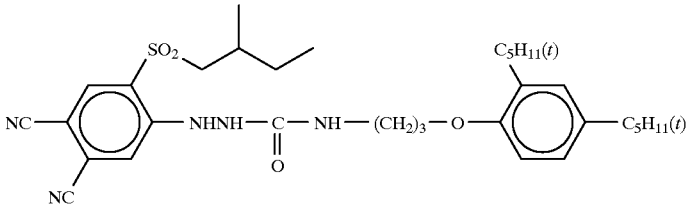
I-64
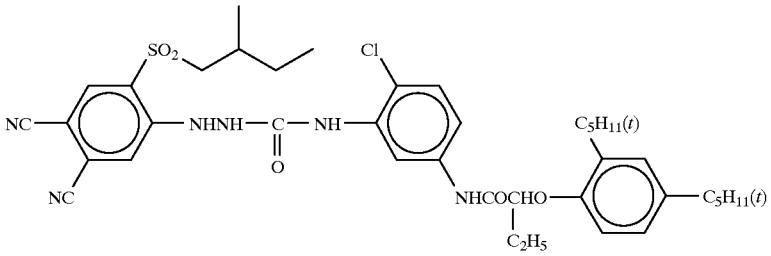
I-65
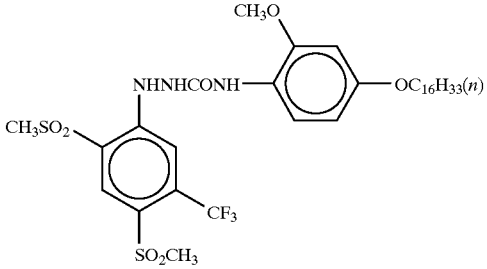
I-66
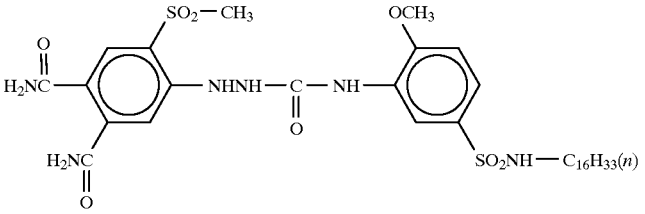

-continued
I-67
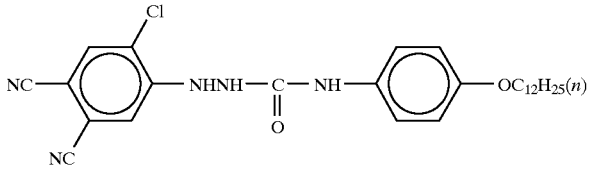
I-68
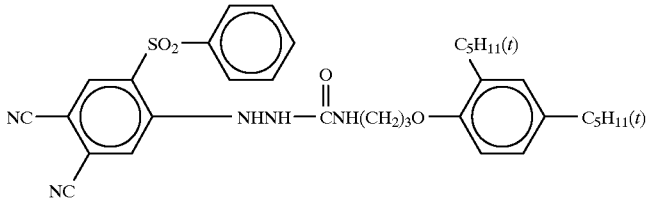
I-69
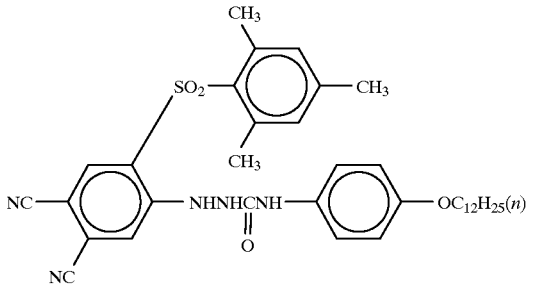
I-70
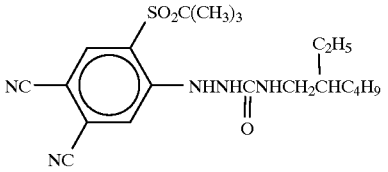
I-71
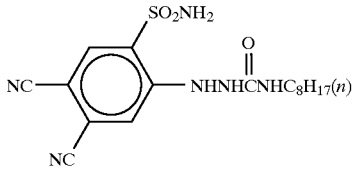
I-72
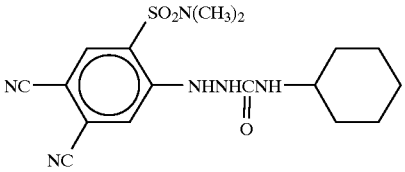
I-73
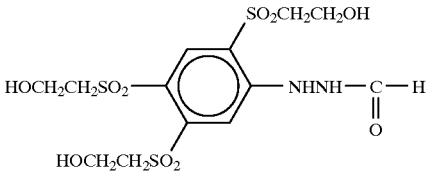
I-74
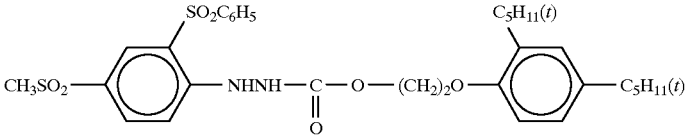
I-75
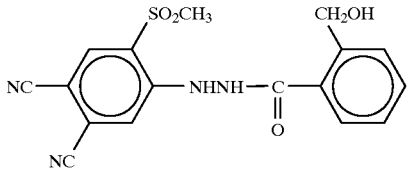
I-76
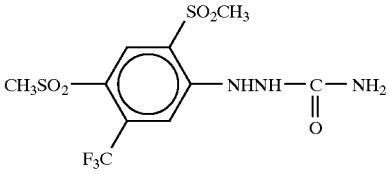

-continued
I-77
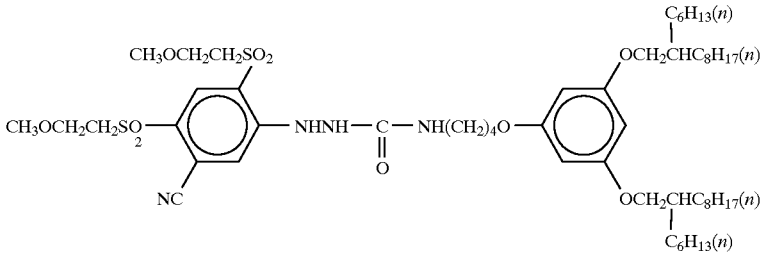
I-78
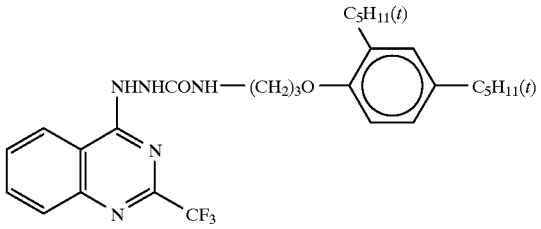
I-79
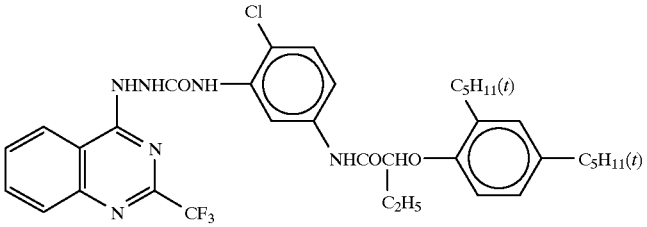
I-80
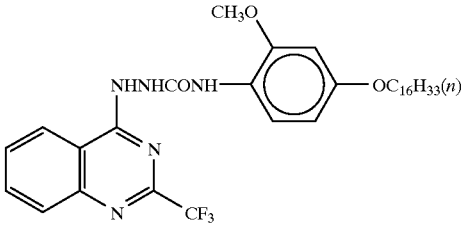
I-81
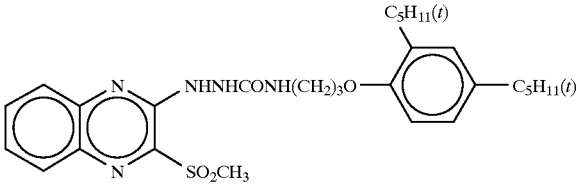
I-82
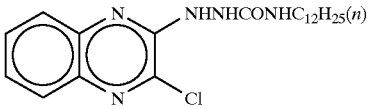
I-83
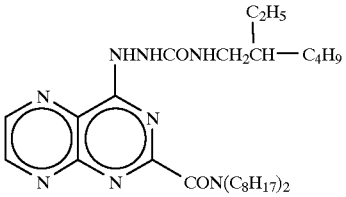
I-84
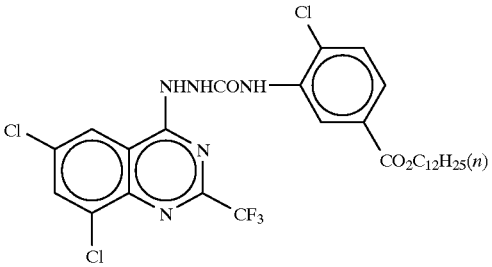
I-85
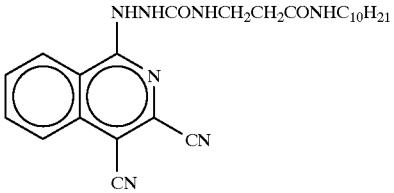
I-86
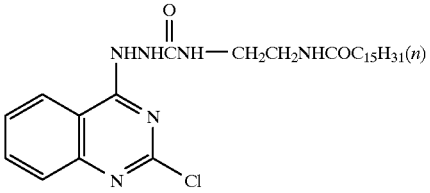

-continued
I-87
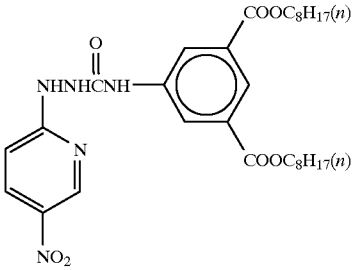
I-88
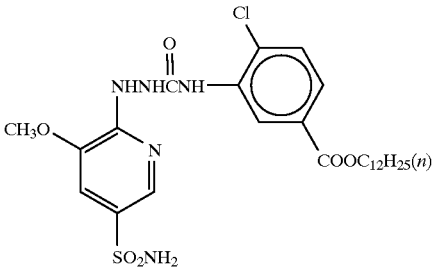
I-89
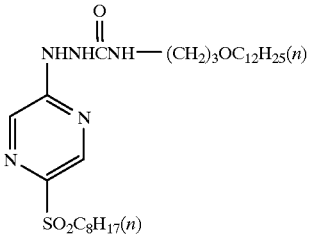
I-90
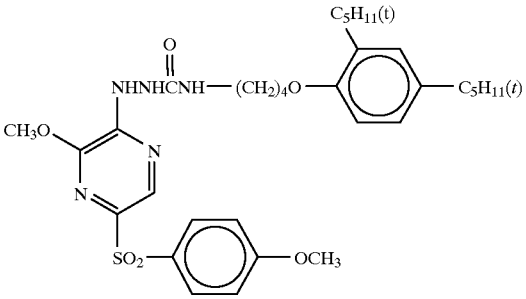
I-91
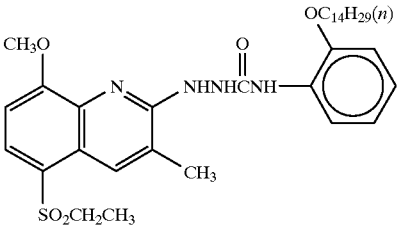
I-92
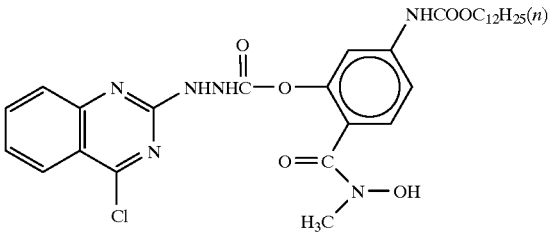
I-93
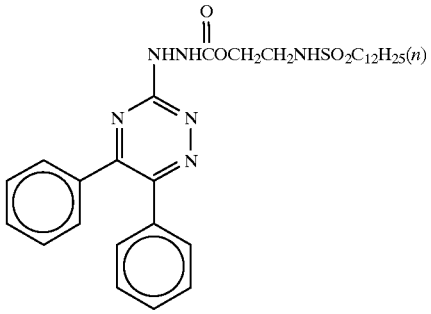
I-94
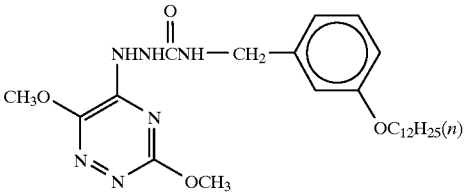
I-95
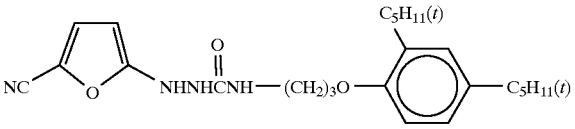
I-96
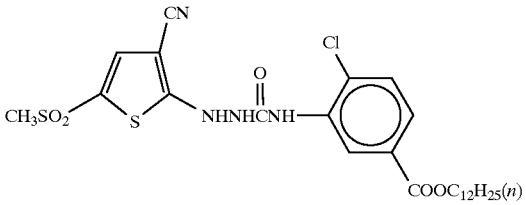
I-97
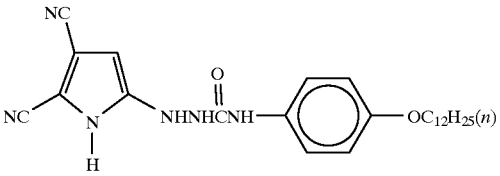

-continued

I-98

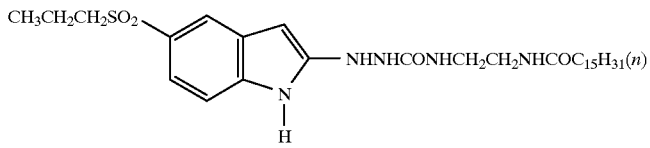

I-99

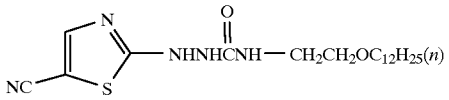

I-100

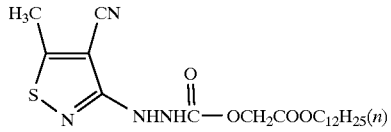

I-101

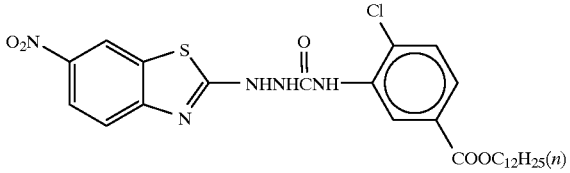

I-102

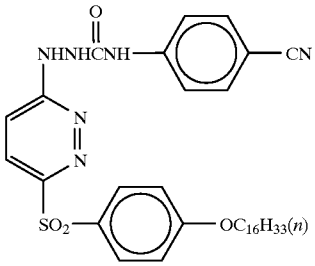

I-103

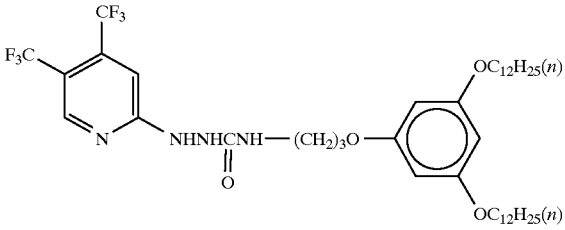

I-104

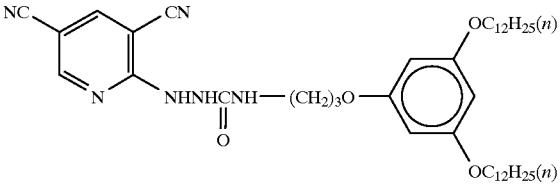

Some of the compounds represented by formula (I) to be used in the present invention are described, for example, in U.S. Pat. Nos. 2,424,256 and 4,481,268, European Patent No. 565,165, and JP-A No. 259249/1986, and other compounds can be synthesized according to methods described therein.

The coupler represented by formula (II) is described in detail below.

In formula (II), $R^{21}$ represents an aliphatic group preferably having 1 to 36 carbon atoms, an aromatic group preferably having 6 to 36 carbon atoms (e.g. phenyl and naphthyl), a heterocyclic group (e.g. 3-pyridyl and 2-furyl), or an aromatic or heterocyclic amino group (e.g. anilino, naphthylamino, 2-benzothiazolyl, and 2-pyridylamino), any of which may be substituted by a group selected from among an alkyl group, an aryl group, a heterocyclic group, an alkoxy group (e.g. methoxy and 2-methoxyethoxy), an aryloxy group (e.g. 2,4-di-tert-amylphenoxy, 2-chlorophenoxy, and 4-cyanophenoxy), an alkenyloxy group (e.g. 2-propenyloxy), an acyl group (e.g. acetyl and benzoyl), an ester group (e.g. butoxycarbonyl, phenoxycarbonyl, acetoxy, benzoyloxy, butoxysulfonyl, and toluenesulfonyloxy), an amido group (e.g. acetylamino, ethylcarbamoyl, dimethylcarbamoyl, methanesulfonamido, and butylsulfamoyl), a sulfamido group (e.g. dipropylsulfamoylamino), an imido group (e.g. succinimido and hydantoinyl), a ureido group (e.g. phenylureido and dimethylureido), an aliphatic or aromatic sulfonyl group (e.g. methanesulfonyl and phenylsulfonyl), an aliphatic or aromatic thio group (e.g. ethylthio and phenylthio), a hydroxyl group, a cyano group, a carboxyl group, a nitro group, a sulfo group, a halogen atom, etc.

In this specification, "the aliphatic group" may be straight-chain, branched, or cyclic, and it means to include a saturated and unsaturated aliphatic group, such as an alkyl group, an alkenyl group, and an alkynyl group (their representative examples are a methyl group, an ethyl group, a butyl group, a dodecyl group, an octadecyl group, an eicosenyl group, an iso-propyl group, a tert-butyl group, a tert-octyl group, a tert-dodecyl group, a cyclohexyl group, a cyclopentyl group, an allyl group, a vinyl group, a 2-hexadecenyl group, and a propargyl group).

$R^{22}$ represents an acylamino group preferably having 1 to 36 carbon atoms (e.g. acetylamino, butyrylamino, tetradecanoylamino, and benzoylamino), which may be substituted by the substituents allowed for $R^{21}$.

$X^{11}$ represents a hydrogen atom, a halogen atom (e.g. fluorine, chlorine, and bromine), an aliphatic group preferably having 1 to 20 carbon atoms, an aromatic group preferably having 6 to 20 carbon atoms, or an acylamino group, any of which may be substituted by the substituents allowed for $R^{21}$.

$R^{22}$ and $X^{11}$ may bond together to form a 5- to 7-membered nitrogen-containing heterocyclic ring, which is preferably a 5- or 6-membered nitrogen-containing heterocyclic ring derived from an acylamino group.

Z represents a hydrogen atom or a coupling split-off group, such as a halogen atom (e.g. fluorine, chlorine, and bromine), an alkoxy group (e.g. ethoxy, dodecyloxy, methoxyethylcarbamoylmethoxy, carboxypropyloxy, and methylsulfonylethoxy), an aryloxy group (e.g. 4-chlorophenoxy, 4-methoxyphenoxy, and 4-carboxyphenoxy), an acyloxy group (e.g. acetoxy, tetradecanoyloxy, and benzoyloxy), a sulfonyloxy group (e.g. methanesulfonyloxy and toluenesulfonyloxy), an amido group (e.g. dichloroacetylamino, heptafluorobutyrylamino, methanesulfonylamino, and toluenesulfonylamino), an alkoxycarbonyloxy group (e.g. ethoxycarbonyloxy and benzyloxycarbonyloxy), an aryloxycarbonyloxy group (e.g. phenoxycarbonyloxy), an aliphatic or aromatic thio group (e.g. ethylthio, phenylthio, and tetrazolylthio), an imido group (e.g. succinimido and hydantoinyl), and an aromatic azo group (e.g. phenylazo), any of which split-off group may contain a photographically useful group.

Preferably, couplers represented by formula (II) are those represented by the following formula (VII):

Formula (VII)

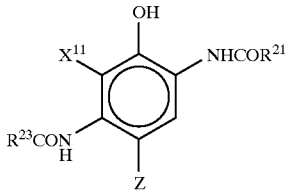

In the above formula (VII), $R^{21}$ preferably represents a substituted alkyl group or a substituted or unsubstituted aryl group. The substituent on the alkyl group is particularly preferably a substituted or unsubstituted phenoxy group and a halogen atom, and the aryl group is particularly preferably a phenyl group that is substituted by at least one halogen atom, alkyl group, sulfonamido group, or acylamino group.

Preferably $R^{23}$ is a substituted alkyl group or a substituted aryl group, and the substituent on the alkyl group is particularly preferably a phenoxy group that may be substituted.

Preferably, $X^{11}$ is a hydrogen atom, an alkyl group, an alkenyl group, an aralkyl group, or an acylamino group.

Preferably $X^{11}$ and $R^{23}$ bond together to form a 5- to 7-membered ring, and particularly preferably a 5- or 6-membered ring.

When the reducing agent for color formation represented by formula (IV-a) is used, preferably Z is a hydrogen atom, in view of the color-forming property, whereas when the reducing agent for color formation represented by formula (IV-b) is used, preferably Z is a halogen atom or an aryloxy group, in view of the color-forming property.

In formulae (II) and (VII), each of $R^{21}$, $R^{22}$, $R^{23}$, and $X^{11}$ may be substituted. In the present invention, $R^{21}$, $R^{22}$, $R^{23}$, and $X^{11}$ each include both substituted groups and unsubstituted ones.

The couplers represented by formula (II) may be used alone or in combination, and they can also be used together with other known couplers (not restricted to cyan couplers).

Specific examples of the cyan coupler represented by formula (II) are listed below:

(C-1)

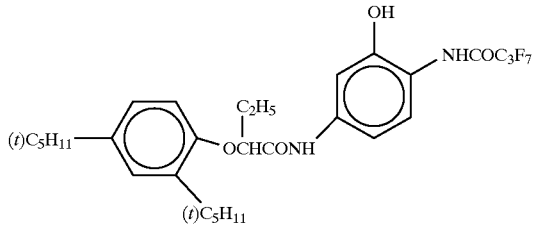

(C-2)

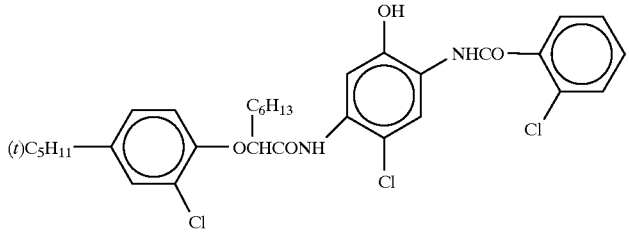

(C-3)

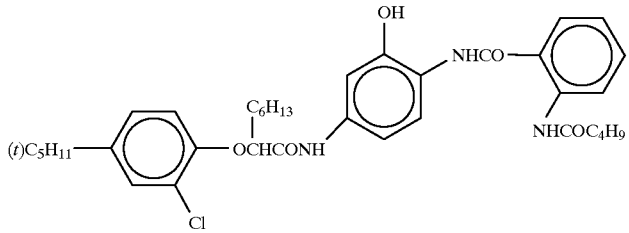

-continued
(C-4)
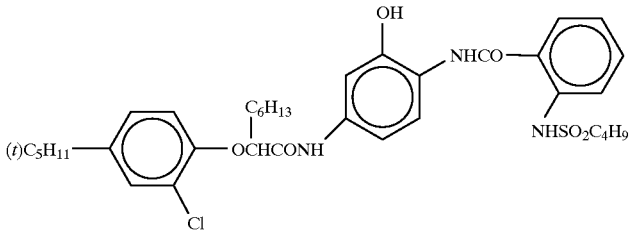
(C-5)
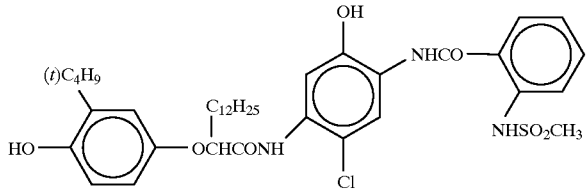
(C-6)
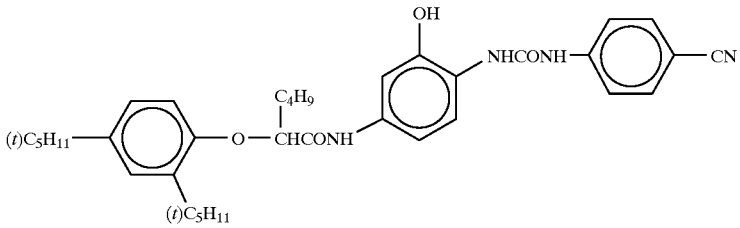
(C-7)
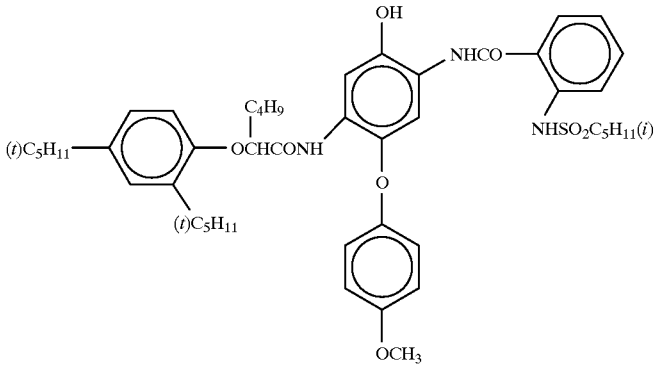
(C-8)
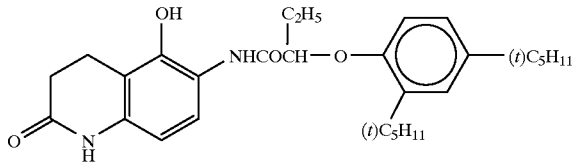
(C-9)
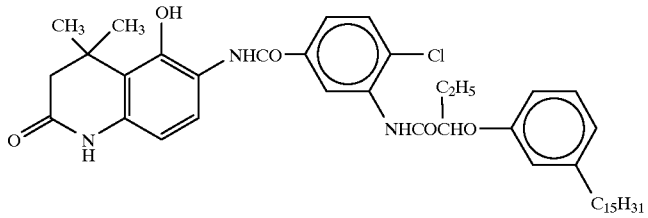

-continued
(C-10)
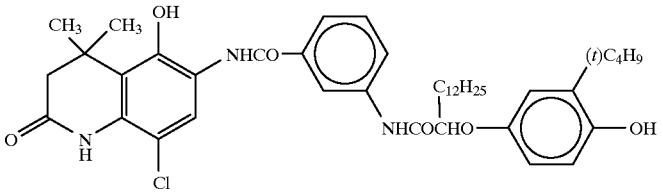
(C-11)
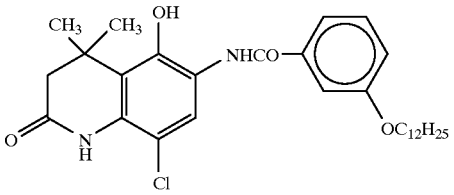
(C-12)
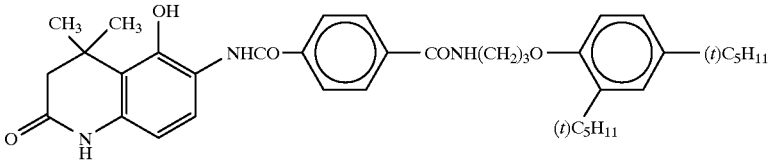
(C-13)
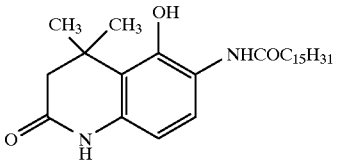
(C-14)
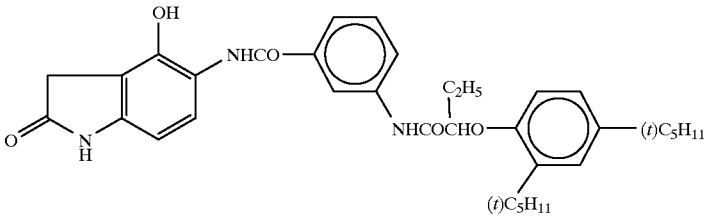
(C-15)
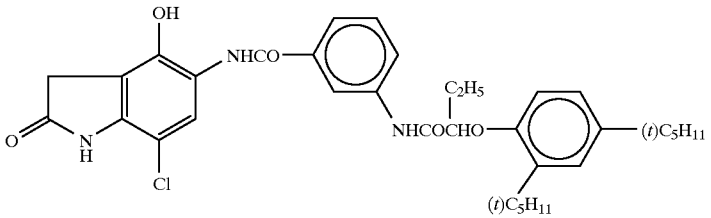
(C-16)
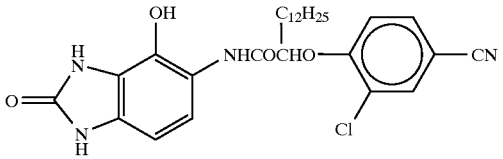

-continued (C-17)

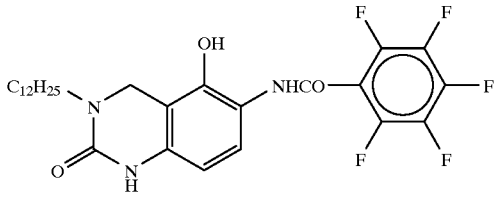

(C-18)

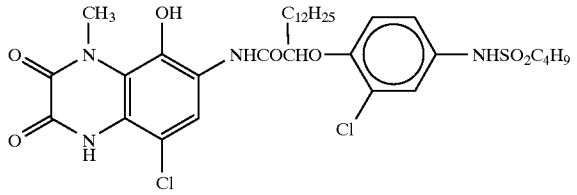

(C-19)

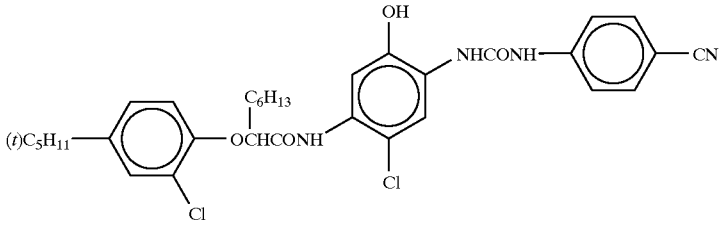

(C-20)

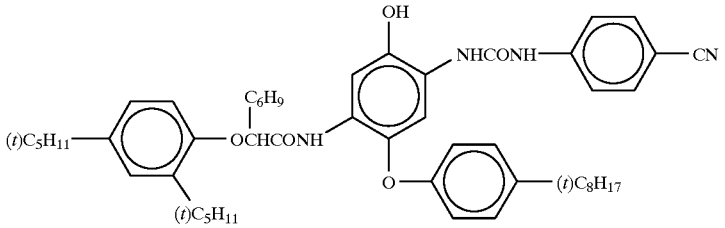

(C-21)

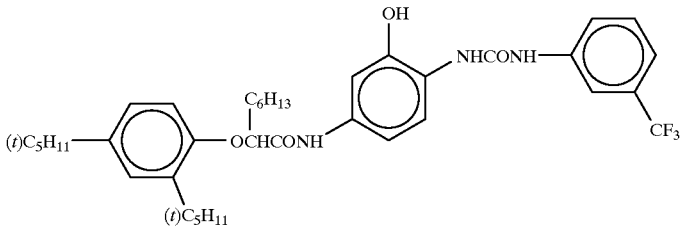

The coupler represented by formula (III) is described in detail below.

$R^{31}$ represents $—CONR^{34}R^{35}$, $—NHCOR^{34}$, $—NHCOOR^{36}$, $—NHSO_2R^{36}$, $—NHCONR^{34}R^{35}$, or $—NHSO_2NR^{34}R^{35}$, wherein $R^{34}$, $R^{35}$, and $R^{36}$ each represent, for example, an aliphatic group having 1 to 30 carbon atoms, an aromatic group having 6 to 30 carbon atoms, or a heterocyclic group having 2 to 30 carbon atoms, or $R^{34}$ and $R^{35}$ each represent a hydrogen atom.

$R^{32}$ represents a group substitutable on a naphthol ring (which substitutable group may be atoms, and this applies also hereinafter), and representative examples are a halogen atom, a hydroxyl group, an amino group, a carboxyl group, a sulfonic acid group, a cyano group, an aromatic group, a heterocyclic group, a carbonamido group, a sulfonamido group, a carbamoyl group, a sulfamoyl group, a ureido group, an acyl group, an acyloxy group, an aliphatic oxy group, an aromatic oxy group, an aliphatic thio group, an aromatic thio group, an aliphatic sulfonyl group, an aromatic sulfonyl group, an sulfamoylamino group, a nitro group, and an imido group. The carbon atoms in $R^{32}$ are 0 to 30 in number. When m is 2, an example of the cyclic $R^{32}$ is a dioxymethylene group.

$R^{33}$ represents an acyl group or an oxycarbonyl group, and preferably an aliphatic or aromatic acyl group or an oxycarbonyl group, any of which may be substituted on its aliphatic or aromatic group.

Specific examples of the acyl group include a formyl group, an acetyl group, a trifluoroacetyl group, a chloroacetyl group, a benzoyl group, a pentafluorobenzoyl group, and a p-chlorobenzoyl group, and specific examples of the oxycarbonyl group include a methoxycarbonyl group, an ethoxycarbonyl group, a butoxycarbonyl group, a decyloxycarbonyl group, a methoxyethoxycarbonyl group, and a phenoxycarbonyl group.

Y represents a hydrogen atom or a coupling split-off group (including coupling split-off atoms, and this also applies hereinafter). Representative examples of the coupling split-off group includes a halogen atom, —$OR^{41}$, —$SR^{41}$, —O(C=O)$R^{41}$, —NHCO$R^{41}$, —NH(C=O)$SR^{41}$, —O(C=O)—$OR^{41}$, —O(C=O)NH$R^{41}$, an aromatic azo group having 6 to 30 carbon atoms, and a heterocyclic group that has 1 to 30 carbon atoms and that will be linked to the coupling active site of a coupler at the nitrogen atom (e.g. succinimido, phthalimido, hydantoinyl, pyrazolyl, and 2-benzotriazolyl), wherein $R^{41}$ represents an aliphatic group having 1 to 30 carbon atoms, an aromatic group having 6 to 30 carbon atoms, or a heterocyclic group having 2 to 30 carbon atoms.

In the present invention, the aliphatic group may be saturated or unsaturated, substituted or unsubstituted, and straight-chain, branched, or cyclic, and typical examples include a methyl group, an ethyl group, a butyl group, a cyclohexyl group, an allyl group, a propargyl group, a methoxyethyl group, an n-decyl group, an n-dodecyl group, an n-hexadecyl group, a trifluoromethyl group, a heptafluoropropyl group, a dodecyloxypropyl group, a 2,4-di-tert-amylphenoxypropyl group, and a 2,4-di-tert-amylphenoxybutyl group.

The aromatic group may be substituted or unsubstituted, and typical examples include a phenyl group, a tolyl group, a 2-tetradecyloxyphenyl group, a pentafluorophenyl group, a 2-chloro-5-dodecyloxycarbonylphenyl group, a 4-chlorophenyl group, a 4-cyanophenyl group, and a 4-hydroxyphenyl group.

The heterocyclic group may be substituted or unsubstituted, and typical examples include a 2-pyridyl group, a 4-pyridyl group, a 2-furyl group, a 4-thienyl group, and a quinolinyl group.

Preferable examples of substituents in the present invention are described below. $R^{31}$ is preferably a substituted or unsubstituted carbamoyl group, and specific examples include a carbamoyl group, an ethylcarbamoyl group, a morpholinocarbonyl group, a dodecylcarbamoyl group, and a hexadecylcarbamoyl group.

With respect to $R^{32}$ and m, preferably m is 0; that is, an unsubstituted one is most preferable, and as $R^{32}$, a halogen atom, an aliphatic group, a carbonamido group, a sulfonamido group, or the like is an allowable substituent.

Preferably Y is a hydrogen atom, a chlorine atom, an aliphatic oxy group [e.g. 2-hydroxyethoxy, 2-chloroethoxy, carboxymethyloxy, 1-carboxyethoxy, 2-methanesulfonylethoxy, 3-carboxypropyloxy, 2-methoxyethoxycarbamoylmethyloxy, 1-carboxytridecyl, 2-(1-carboxytridecylthio)ethyloxy, 2-carboxymethylthioethyloxy, and 2-methanesulfonamidoethyloxy], an aromatic oxy group [e.g. 4-acetoamidophenoxy, 2-acetamidophenoxy, and 4-(3-carboxypropaneamido)phenoxy], or a carbamoyloxy group (e.g. ethylcarbamoyloxy and phenylcarbamoyloxy). When the reducing agent for color formation represented by formula (IV-a) is used, a hydrogen atom is most preferable, in view of the color-forming property, whereas when the reducing agent for color formation represented by formula (IV-b) is used, a halogen atom or an aromatic oxy group is most preferable, in view of the color-forming property.

The coupler represented by formula (III) may form a dimer or higher polymer by combining through a bivalent or higher-valent group at the substituent $R^{31}$, $R^{32}$, $R^{33}$, or Y. In this case, the number of carbon atoms shown above for each substituent may fall outside the above range.

Specific examples of the coupler represented by formula (III) are shown below, but couplers used in the present invention are not limited to them.

(N-1)

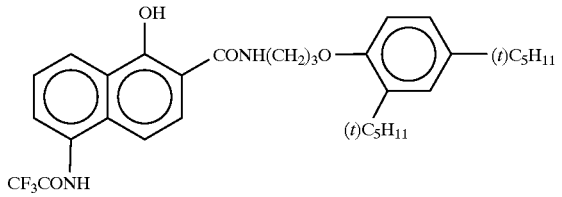

(N-2)

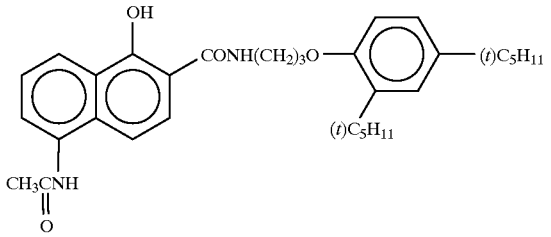

-continued
(N-3)
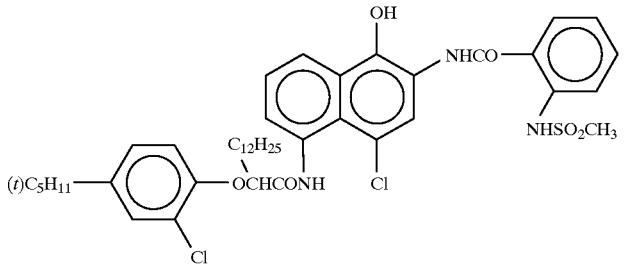
(N-4)
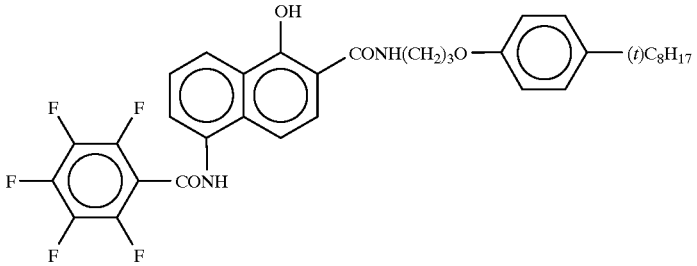
(N-5)
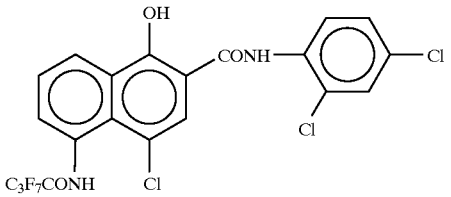
(N-6)
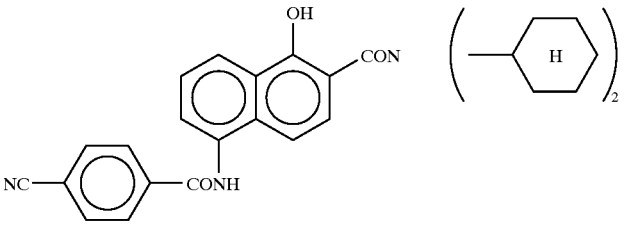
(N-7)
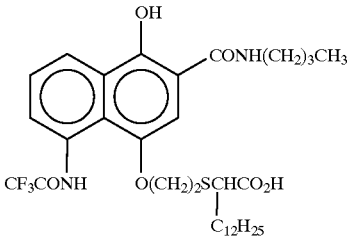
(N-8)
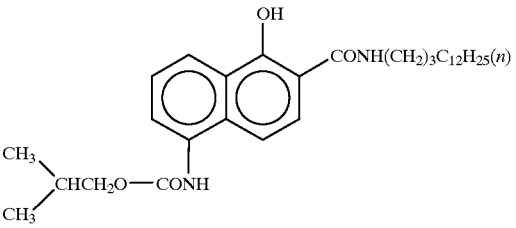

-continued
(N-9)
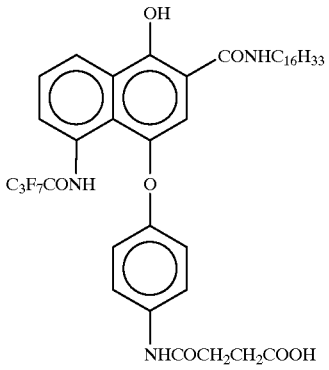
(N-10)
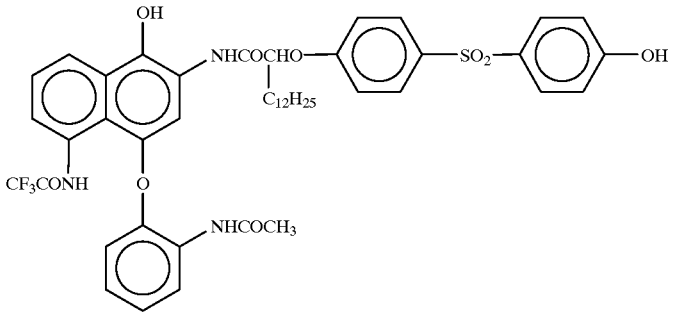
(N-11)
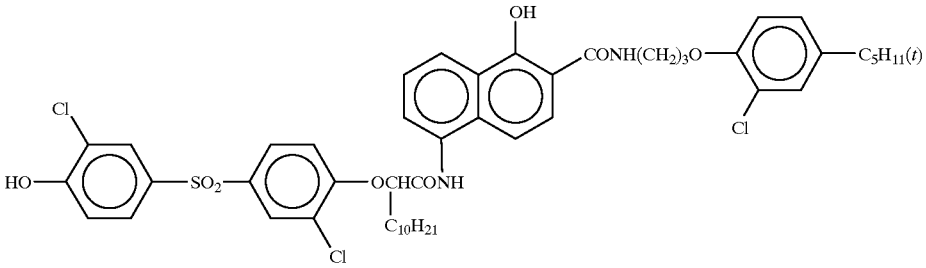
(N-12)
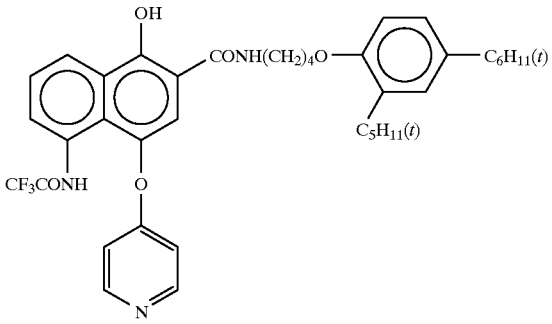

-continued
(N-13)
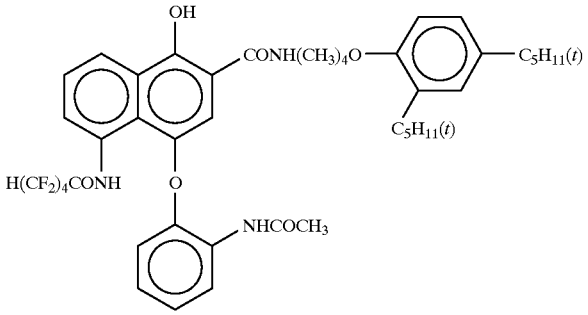
(N-14)
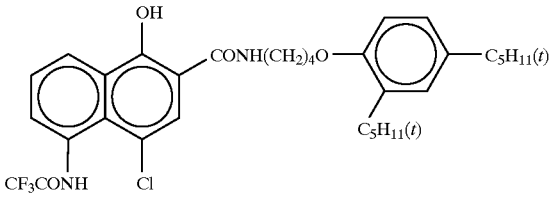
(N-15)
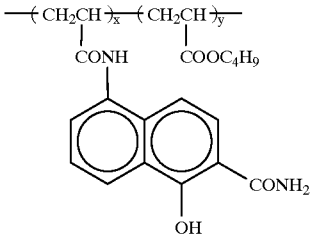
(N-16)
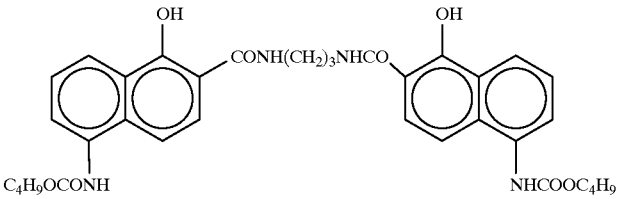
(N-17)
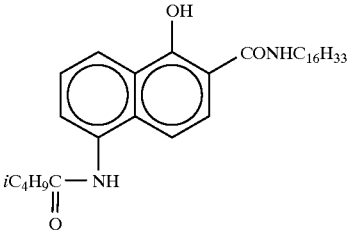
(N-18)
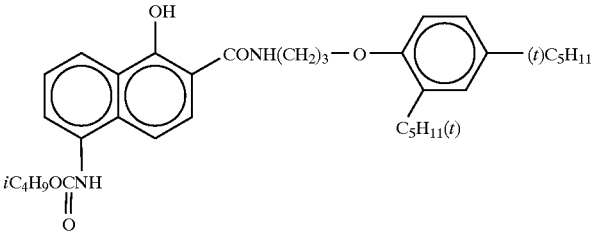

-continued (N-19)

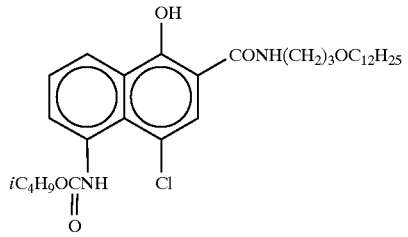

(N-20)

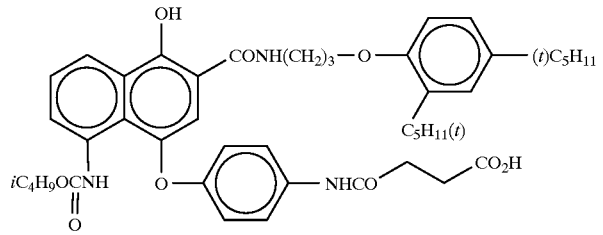

The color-forming reducing agent according to the present invention is preferably used in an amount of 0.01 to 10 mmol/$m^2$ in one color-forming layer, in order to obtain satisfactory color density. More preferably the amount to be used is 0.05 to 5 mmol/$m^2$, and particularly preferably 0.1 to 1 mmol/$m^2$.

A preferable amount of the coupler to be used in the color-forming layer in which the color-forming reducing agent according to the present invention is used, is 0.05 to 20 times, more preferably 0.1 to 10 times, and particularly preferably 0.2 to 5 times, the amount of the color-forming reducing agent in terms of mol.

The color light-sensitive material of the present invention comprises, basically, a photographic constitutional layer(s) coated on a support (base), which layer(s) contains a photosensitive silver halide, a coupler for forming a dye (also referred to as a dye-forming coupler or a coupler), a reducing agent for color formation (also referred to as a color-forming reducing agent), and a binder.

The dye-forming coupler and the color-forming reducing agent to be used in the present invention are added to the same layer, which is the most representative mode, but they may be added separately to separate layers if they are placed in the reactive state. Preferably these components are added to a silver halide emulsion layer of the light-sensitive material or a layer adjacent to it, and particularly preferably all of these components are added to a silver halide emulsion layer.

The color-forming reducing agent and the coupler according to the present invention can be introduced into the light-sensitive material by various known dispersion methods. Preferably the oil-in-water dispersion method is used, in which they are dissolved in a high-boiling organic solvent (and, if necessary, together with a low-boiling organic solvent), the solution is emulsified and dispersed in an aqueous gelatin solution, and the emulsified dispersion is added to a silver halide emulsion. The high-boiling organic solvent to be used in the present invention is preferably a compound nonmiscible with water, and having a melting point of 100° C. or below and a boiling point of 140° C. or over, that is a good solvent for the color-forming reducing agents and couplers. The melting point of the high-boiling organic solvent is preferably 80° C. or below. The boiling point of the high-boiling organic solvent is more preferably 160° C. or over, and even further preferably 170° C. or over. Details of these high-boiling organic solvents are described in JP-A No. 215272/1987, page 137, lower right column, to page 144, upper right column. In the present invention, the amount of the high-boiling organic solvent to be used may be any amount, but preferably the amount is such that the weight ratio of the high-boiling organic solvent to the color-forming reducing agent is 20 or less, more preferably from 0.02 to 5.

Further, in the present invention, known polymer dispersion methods can be used. Specific examples of steps, effects, and latexes for impregnation of the latex dispersion method, which is one polymer dispersion method, are described, for example, in U.S. Pat. No. 4,199,363, West Germany Patent Application (OLS) Nos. 2,541,274 and 2,541,230, JP-B ("JP-B" means examined Japanese patent publication) No. 41091/1978, and European Patent Publication No. 029104, and a dispersion method using a polymer which is organic solvent-soluble is described in PCT International Publication No. WO 88/00723.

The lipophilic fine particles containing the color-forming reducing agent according to the present invention may have any average grain size. In light of color-forming property, the average particle size is preferably 0.05 to 0.3 $\mu$m, and further preferably 0.05 to 0.2 $\mu$m.

To make the average particle size of lipophilic fine particles small is generally accomplished, for example, by choosing a type of surface-active agent, by increasing the amount of the surface-active agent to be used, by elevating the viscosity of the hydrophilic colloid solution, by lowering the viscosity of the lipophilic organic layer, through use of an additional low-boiling organic solvent, by increasing the rotational frequency of the stirring blades of an emulsifying apparatus, to increase the shearing force, or by prolonging the emulsifying time.

The particle size of lipophilic fine particles can be measured by an apparatus, such as a Nanosizer (trade name, manufactured by British Coulter Co.).

As the support to be used in the present invention, any support can be used if it is a transmissible support or a reflective support, on which a photographic emulsion layer can be coated, such as glass, paper, and plastic film.

As the plastic film to be used in the present invention, for example, polyester films made, for example, of polyethylene terephthalates, polyethylene naphthalates, cellulose triacetate, or cellulose nitrate; polyamide films, polycarbonate films, and polystyrene films can be used.

"The reflective support" that can be used in the present invention refers to a support that increases the reflecting properties to make bright the dye image formed in the silver halide emulsion layer, and such a reflective support includes a support coated with a hydrophobic resin containing a light-reflecting substance, such as titanium oxide, zinc oxide, calcium oxide, and calcium sulfate, dispersed therein, or a support made of a hydrophobic resin itself containing a dispersed light-reflecting substance. Examples are a polyethylene-coated paper, a polyester-coated paper, a polypropylene-series synthetic paper, a support having a reflective layer or using a reflecting substance, such as a glass sheet; a polyester film made, for example, of a polyethylene terephthalate, cellulose triacetate, or cellulose nitrate; a polyamide film, a polycarbonate film, a polystyrene film, and a vinyl chloride resin. As the polyester-coated paper, particularly a polyester-coated paper whose major component is a polyethylene terephthalate, as described in European Patent EP 0,507,489, is preferably used.

The reflective support to be used in the present invention is preferably a paper support, both surfaces of which are coated with a water-resistant resin layer, and at least one of the water-resistant resin layers contains fine particles of a white pigment. Preferably the particles of a white pigment are contained in a density of 12% or more by weight, and more preferably 14% or more by weight. Preferably the light-reflecting white pigment is kneaded well in the presence of a surface-active agent, and the surface of the pigment particles is treated with a dihydric to tetrehydric alcohol.

In the present invention, a support having the second kind diffuse reflective surface can also be used, preferably. "The second kind diffuse reflectivity" means diffuse reflectivity obtained by making a specular surface uneven, to form finely divided specular surfaces facing different directions, and then dispersing a direction of divided fine surface (specular surface). The unevenness of the second kind diffuse reflective surface has a three-dimensional average coarseness of generally 0.1 to 2 $\mu$m, and preferably 0.1 to 1.2 $\mu$m, for the center surface. Details about such a support are described in JP-A No. 239244/1990.

In order to obtain colors ranging widely on the chromaticity diagram by using three primary colors: yellow, magenta, and cyan, use is made of a combination of at least three silver halide emulsion layers photosensitive to respectively different spectral regions. For example, a combination of three layers of a blue-sensitive layer, a green-sensitive layer, and a red-sensitive layer, and a combination of a green-sensitive layer, a red-sensitive layer, and an infrared-sensitive layer, and the like can be coated on the above support. The light-sensitive layers can be arranged in various orders known generally for color light-sensitive materials. Further, each of these light-sensitive layers can be divided into two or more layers if necessary.

In the light-sensitive material, photographic constitutional layers comprising the above photosensitive layers and various auxiliary layers, such as a protective layer, an underlayer, an intermediate layer, an antihalation layer, and a backing layer, can be provided. Further, in order to improve the color separation, various filter dyes can be added to the photographic constitutional layer.

The silver halide grains used in the present invention are made of silver bromide, silver chloride, silver iodide, silver chlorobromide, silver chloroiodide, silver iodobromide, or silver chloroiodobromide. Other silver salts, such as silver rhodanate, silver sulfide, silver selenide, silver carbonate, silver phosphate, or a silver salt of an organic acid, may be contained in the form of independent grains or as part of silver halide grains. If it is desired to make the development/desilvering (bleaching, fixing, and bleach-fix) step rapid, silver chloride grains or silver chlorobromide grains having a high silver chloride content (preferably 95 mol % or more) are desirable. Further, if the development is to be restrained moderately, it is preferable to contain silver iodide. The preferable silver iodide content varies depending on the intended light-sensitive material. For example, in the case of X-ray photographic materials, the preferable silver iodide content is in the range of 0.1 to 15 mol %, and in the case of graphic art and micro photographic materials, the preferable silver iodide content is in the range of 0.1 to 5 mol %. In the case of photographic materials represented by color negatives, preferably silver halide contains 1 to 30 mol %, more preferably 5 to 20 mol %, and particularly preferably 8 to 15 mol %, of silver iodide. It is preferable to incorporate silver chloride in silver iodobromide grains, because the lattice strain can be made less intense. For a reflect-type light-sensitive material that is necessary to be rapidly processed, the silver iodide content is preferably 0, or 1 mol % or below.

In the silver halide grains used in the present invention, in accordance with the purpose, any of regular crystals having no twin plane, and those described in "Shashin Kogyo no Kiso, Ginen Shashin-hen", edited by Nihon Shashin-gakkai (Corona Co.), page 163, such as single twins having one twin plane, parallel multiple twins having two or more parallel twin planes, and nonparallel multiple twins having two or more nonparallel twin planes, can be chosen and used. An example in which grains different in shape are mixed is disclosed in U.S. Pat. No. 4,865,964, and if necessary this method can be chosen. In the case of regular crystals, cubes having (100) planes, octahedrons having (111) planes, and dodecahedral grains having (110) planes, as disclosed in JP-B No. 42737/1980 and JP-A No. 222842/1985, can be used. Further, (h11) plane grains represented by (211), (hh1) plane grains represented by (331), (hk0) plane grains represented by (210) planes, and (hk1) plane grains represented by (321) planes, as reported in "Journal of Imaging Science", Vol. 30, page 247 (1986), can be chosen and used in accordance with the purpose, although the preparation is required to be adjusted. Grains having two or more planes in one grain, such as tetradecahedral grains having (100) and (111) planes in one grain, grains having (100) and (110) planes in one grain, or grains having (111) and (110) planes in one grain, can be chosen and used in accordance with the purpose.

The value obtained by dividing the diameter of the projected area, which is assumed to be a circle, by the thickness of the grain, is called an aspect ratio, which defines the shape of tabular grains. Tabular grains having an aspect ratio grater than 1 can be used in the present invention. Tabular grains can be prepared by methods described, for example, by Cleav in "Photography Theory and Practice" (1930), page 131; by Gutof in "Photographic Science and Engineering", Vol. 14, pages 248 to 257 (1970); and in U.S. Pat. Nos. 4,434,226, 4,414,310, 4,433,048, and 4,439,520, and British Patent No. 2,112,157. When tabular grains are used, such merits are obtained that the covering power is increased and the color sensitization efficiency due to a sensitizing dye is increased, as described in detail in the above-mentioned U.S. Pat. No. 4,434,226. The average aspect ratio of 80% or more of all the projected areas of grains is desirably 1 or more but less than 100, more preferably 2 or more but less than 20, and particularly preferably 3 or more but less than 10. As the shape of tabular grains, a triangle, a hexagon, a circle, and the like can be chosen. A regular hexagonal shape having six approximately equal sides, described in U.S. Pat. No. 4,797,354, is a preferable mode.

In many cases, the grain size of tabular grains is expressed by the diameter of the projected area assumed to be a circle, and grains having an average diameter of 0.6 microns or below, as described in U.S. Pat. No. 4,748,106, are preferable, because the quality of the image is made high. An emulsion having a narrow grain size distribution, as described in U.S. Pat. No. 4,775,617, is also preferable. It is preferable to restrict the shape of tabular grains so that the thickness of the grains may be 0.5 microns or below, and more preferably 0.3 microns or below, because the sharpness is increased. Further, an emulsion in which the grains are highly uniform in thickness, with the deviation coefficient of grain thickness being 30% or below, is also preferable. Grains in which the thickness of the grains and the plane distance between twin planes are defined, as described in JP-A No. 163451/1988, are also preferable.

In the case of tabular grains, the dislocation lines can be observed by a transmission electron microscope. In accordance with the purpose, it is preferable to choose grains having no dislocation lines, grains having several dislocation lines, or grains having many dislocation lines. Dislocation introduced straight in a specific direction in the crystal orientation of grains, or curved dislocation, can be chosen, and it is possible to choose from, for example, dislocation introduced throughout grains, dislocation introduced in a particular part of grains, and dislocation introduced limitedly, for example, to the fringes of grains. In addition to the case of introduction of dislocation lines into tabular grains, also preferable is the case of introduction of dislocation lines into regular crystalline grains or irregular grains, represented by potato grains. In this case, a preferable mode is that introduction is limited to a particular part of grains, such as vertexes and edges.

The silver halide emulsion used in the present invention may be subjected to a treatment for making grains round, as disclosed, for example, in European Patent Nos. 96,727B1 and 64,412B1, or it may be improved in the surface, as disclosed in West Germany Patent No. 2,306,447C2 and JP-A No. 221320/1985.

Generally, the grain surface has a flat structure, but it is also preferable in some cases to make the grain surface uneven intentionally. Examples are a technique in which part of crystals, for example, vertexes and the centers of planes, are formed with holes, as described in JP-A Nos. 106532/1983 and 221320/1985, and ruffled grains, as described in U.S. Pat. No. 4,643,966.

The grain size of the emulsion used in the present invention is evaluated, for example, by the diameter of the projected area equivalent to a circle using an electron microscope; by the diameter of the grain volume equivalent to a sphere, calculated from the projected area and the grain thickness; or by the diameter of a volume equivalent to a sphere, using the Coulter Counter method. A selection can be made from ultrafine grains having a sphere-equivalent diameter of 0.05 microns or below, and coarse grains having a sphere-equivalent diameter of 10 microns or more. Preferably grains of 0.1 microns or more but 3 microns or less are used as photosensitive silver halide grains.

As the emulsion used in the present invention, an emulsion having a wide grain size distribution, that is, a so-called polydisperse emulsion, or an emulsion having a narrow grain size distribution, that is, a so-called monodisperse emulsion, can be chosen and used in accordance with the purpose. As the scale for representing the size distribution, the deviation coefficient of the diameter of the projected area of the grain equivalent to a circle, or the deviation coefficient of the sphere-equivalent diameters of the volume, can be used. If a monodisperse emulsion is used, it is good to use an emulsion having such a size distribution that the deviation coefficient is 25% or below, more preferably 20% or below, and further more preferably 15% or below.

Further, in order to allow the light-sensitive material to satisfy the intended gradation, in an emulsion layer having substantially the same color sensitivity, two or more monodisperse silver halide emulsions different in grain size are mixed and applied to the same layer or are applied as overlaid layers. Further, two or more polydisperse silver halide emulsions can be used as a mixture; or they can be used to form overlaid layers; or a combination of a monodisperse emulsion and a polydisperse emulsion can be used as a mixture; or the combination can be used to form overlaid layers.

The photographic emulsion used in the present invention can be prepared by a method described, for example, by P. Glafkides in "Chemie et Phisique Photographique," Paul Montel, 1967; by G. F. Duffin in "Photographic Emulsion Chemistry," Focal Press, 1966; or by V. L. Zelikman et al. in "Making and Coating Photographic Emulsion," Focal Press, 1964. That is, any of the acid process, the neutral process, the ammonia process, and the like can be used; and to react a soluble silver salt with a soluble halogen salt, any of the single-jet method, the double-jet method, a combination thereof, and the like can be used. A method wherein grains are formed in the presence of excess silver ions (the so-called reverse precipitation process) can also be used. As one type of the double-jet method, a method wherein pAg in the liquid phase, in which a silver halide will be formed, is kept constant, that is, the so-called controlled double-jet method, can also be used. According to this method, a silver halide emulsion wherein the crystals are regular in shape and whose grain size is approximately uniform, can be obtained.

When the emulsion according to the present invention is prepared, in accordance with the purpose, it is preferable to allow a salt of a metal ion to be present, for example, at the time when grains are formed, in the step of desalting, at the time when the chemical sensitization is carried out, or before the application. When the grains are doped, the addition is preferably carried out at the time when the grains are formed; or after the formation of the grains, but before the completion of the chemical sensitization, when the surface of the grains is modified or when the salt of a metal ion is used as a chemical sensitizer. As to the doping of grains, selection can be made from a case in which the whole grains are doped, one in which only the core parts of the grains are doped, one in which only the shell parts of the grains are doped, one in which only the epitaxial parts of the grains are doped, and one in which only the substrate grains are doped. For example, Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi can be used. These metals can be added if they are in the form of a salt that is soluble at the time when grains are formed, such as an ammonium salt, an acetate, a nitrate, a sulfate, a phosphate, a hydroxide, a six-coordinate complex, and a four-coordinate complex. Examples include $CdBr_2$, $CdCl_2$, $Cd(NO_3)_2$, $Pd(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, and $K_4Ru(CN)_6$. As a ligand of the coordination compound, one can be selected from a halogen, $H_2O$, a cyano group, a cyanate group, a thiocyanate group, a nitrosyl group, a thionitrosyl group, an oxo group, and a carbonyl group. With respect to these metal compounds, only one can be used, but two or more can also be used in combination.

In some cases, a method wherein a chalcogen compound is added during the preparation of the emulsion, as described in U.S. Pat. No. 3,772,031, is also useful. In addition to S, Se, and Te, a cyanate, a thiocyanate, a selenocyanate, a carbonate, a phosphate, or an acetate may be present.

The silver halide grains according to the present invention can be subjected to at least one of sulfur sensitization, selenium sensitization, tellurium sensitization (these three are called chalcogen sensitization, collectively), noble metal sensitization, and reduction sensitization, in any step of the production for the silver halide emulsion. A combination of two or more sensitizations is preferable. Various types of emulsions can be produced, depending on the steps in which the chemical sensitization is carried out. There are a type wherein chemical sensitizing nuclei are embedded in grains, a type wherein chemical sensitizing nuclei are embedded at parts near the surface of grains, and a type wherein chemical sensitizing nuclei are formed on the surface. In the emulsion according to the present invention, the location at which chemical sensitizing nuclei are situated can be selected in accordance with the purpose, and generally preferably at least one type of chemical sensitizing nucleus is formed near the surface.

Chemical sensitizations that can be carried out preferably in the present invention are chalcogen sensitization and noble metal sensitization, which may be used singly or in combination; and the chemical sensitization can be carried out by using active gelatin, as described by T. H. James in "The Theory of the Photographic Process," 4th edition, Macmillan, 1997, pages 67 to 76, or by using sulfur, selenium, tellurium, gold, platinum, palladium, or iridium, or a combination of these sensitizing agents, at a pAg of 5 to 10, a pH of 5 to 8, and a temperature of 30 to 80° C., as described in Research Disclosure, Item 12008 (April 1974); Research Disclosure, Item 13452 (June 1975); Research Disclosure, Item 307105 (November 1989); U.S. Pat. Nos. 2,642,361, 3,297,446, 3,772,031, 3,857,711, 3,901,714, 4,266,018, and 3,904,415, and British Patent No. 1,315,755.

In the photographic emulsion used in the present invention, various compounds can be incorporated for the purpose of preventing fogging during the process of the production of the light-sensitive material, during the storage of the light-sensitive material, or during the photographic processing, or for the purpose of stabilizing the photographic performance. That is, compounds known as antifoggants or stabilizers can be added, such as thiazoles including benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly 1-phenyl-5-mercaptotetrazole and the like); mercaptopyrimidines; mercaptotriazines; thioketo compounds, such as oxazolinthione; azaindenes, such as triazaindenes, tetraazaindenes (particularly 4-hydroxy-6-methyl-1,3,3a,7-tetraazaindenes), and pentaazaindenes. For examples, those described in U.S. Pat. Nos. 3,954,474 and 3,982,947, and JP-B No. 28660/1987, can be used. A preferable compound is a compound described in Japanese patent application No. 47225/1987 (JP-A No. 212932/1988). In accordance with the purpose, the antifoggant and the stabilizer can be added at various times, for example, before the formation of the grains, during the formation of the grains, after the formation of the grains, in the step of washing with water, at the time of dispersion after the washing with water, before the chemical sensitization, during the chemical sensitization, after the chemical sensitization, and before the application. In addition to the case wherein the antifoggant and the stabilizer are added during the preparation of the emulsion, so that the antifogging effect and the stabilizing effect, which are their essential effects, may be achieved, they can be used for various other purposes, for example, for controlling the habit of the crystals, for making the grain size small, for reducing the solubility of the grains, for controlling the chemical sensitization, and for controlling the arrangement of the dyes.

In order to exhibit the effect of the present invention, the photographic emulsion used in the present invention is preferably spectrally-sensitized by methin dyes or other dyes. Dyes that can be used include a cyanine dye, a merocyanine dye, a composite cyanin dye, a composite merocyanine dye, a halopolar cyanine dye, a hemicyanine dye, a styryl dye, and a hemioxonol dye. Particularly useful dyes are those belonging to a cyanine dye, a merocyanine dye, and a composite merocyanine dye. In these dyes, any of nuclei generally used in cyanine dyes as a basic heterocyclic nuclei can be applied. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, and a pyridine nucleus; and a nucleus formed by fusing an cycloaliphatic hydrocarbon ring or an aromatic hydrocarbon ring to these nuclei, such as an indolenine nucleus, a benzindolenine nucleus, an indole nucleus, a benzoxazole nucleus, a naphthooxazole nucleus, a benzothiazole nucleus, a naphthothiazole nucleus, a benzoselenazole nucleus, a benzimidazole nucleus, and a quinoline nucleus, can be applied. These nuclei may be substituted on the carbon atom.

In the merocyanine dye or the composite merocyanine dye, as a nucleus having a ketomethylene structure, a 5- to 6-membered heterocyclic nucleus, such as a pyrazolin-5-one nucleus, a thiohydantoine nucleus, a 2-thiooxazolidin-2,4-dione nucleus, a thiazolidin-2,4-dione nucleus, a rhodanine nucleus, and a thiobarbituric acid nucleus, can be applied.

Further, as the red-sensitive spectrally sensitizing dye of silver halide emulsion grains high in silver chloride content, red-sensitive spectrally sensitizing dyes described in JP-A No. 123340/1991 are quite preferable, in view of the stability, the powerfulness of the absorption, the dependency of exposure on temperature, etc.

In the light-sensitive material of the present invention, if the infrared region is to be spectrally sensitized efficiently, sensitizing dyes described in JP-A No. 15049/1991 (the upper left column, page 12, to the lower left column, page 21), JP-A No. 20730/1991 (the lower left column, page 4, to the lower left column, page 15), EP-0,420,011 (page 4, line 21, to page 6, line 54), EP-0,420,012 (page 4, line 12, to page 10, line 33), EP-0,443,466, and U.S. Pat. No. 4,975,362 are preferably used.

The time at which the sensitizing dye is added to the emulsion may be at any stage for preparing the emulsion that is known to be useful. Most generally, although the addition of the sensitizing dye is carried out at a time after the completion of chemical sensitization and before the coating, the sensitizing dye may be added together with a chemical sensitizer simultaneously, to carry out the spectral sensitization and the chemical sensitization at the same time, as described in U.S. Pat. Nos. 3,628,969 and 4,225,666; or the sensitizing dye may be added before the chemical sensitization, as described in JP-A No. 113,928/1983; or the sensitizing dye may be added before the completion of the formation of the silver halide grain precipitation, to start the spectral sensitization. Further, as taught in U.S. Pat. No. 4,225,666, the above compounds may be added in portions; that is, it is possible that part of these compounds is added before the chemical sensitization, with the remaining part added after the chemical sensitization; thus they may be added at any time during the formation of silver halide grains, for example, as shown in a method disclosed in U.S. Pat. No. 4,183,756.

In the present invention, in combination with the water-soluble dye, a colored layer that can be decolored by processing can be used. The colored layer to be used that can be decolored by processing may be directly adjacent to the emulsion layer, or it may be arranged to be adjacent to the emulsion layer through an intermediate layer containing a processing color-mixing inhibitor, such as gelatin and hydroquinone. Preferably the colored layer is arranged below (on the side of the support) an emulsion layer that will form the same primary color as the color of the colored layer. All or some of colored layers corresponding to respective primary colors may be arranged. Also, colored layer corresponding to primary color regions may be arranged. The optical reflection density of the colored layer is preferably such that the optical density value at the wavelength having the highest optical density in the wavelength region used for exposure (the visible light region of from 400 nm to 700 nm, in the case of usual printer exposure, and the wavelength of the scanning exposure light source to be used, in the case of scanning exposure) is 0.2 or more, but 3.0 or less, more preferably 0.5 or more, but 2.5 or less, and particularly preferably 0.8 or more, but 2.0 or less.

To form the colored layer, conventionally known methods can be applied in combination. For example, use can be made of a method wherein dyes described in JP-A No. 282244/1990 (page 3, the upper right column, to page 8), or dyes described in JP-A No. 7931/1991 (page 3, the upper right column, to page 11, the lower left column), are made into a solid fine particle dispersion state and are contained in a hydrophilic colloid layer; a method wherein a cationic polymer is mordanted with an anionic dye; a method wherein a dye is adsorbed to fine particles, for example, of a silver halide, and is fixed in a layer; and a method, as described in JP-A No. 239544/1989, wherein colloidal silver is used. One method wherein a fine powder of a dye is dispersed in the solid state is described in JP-A No. 308244/1990 (pages 4 to 13); in the method, for example, a fine powder dye, which is substantially insoluble in water, at least at a pH of 6 or below, but which is substantially soluble in water, at least at a pH of 8 or over, is contained. Further, a method wherein a cation polymer is mordanted with an anionic dye is described in JP-A No. 84637/1990 (pages 18 to 26). Methods of the preparation of colloidal silver as a light absorber are described in U.S. Pat. Nos. 2,688,601 and 3,459,563. Among these methods, one in which a fine powder dye is contained, and one in which colloidal silver is used, are preferable.

As a binder or a protective colloid that can be used in the light-sensitive material according to the present invention, a gelatin is advantageously used, and other hydrophilic colloids can be used alone or in combination with a gelatin. As the gelatin, a low-calcium gelatin having a calcium content of 800 ppm or less, and more preferably 200 ppm or less, is preferably used. Further, in order to prevent the proliferation of various molds and fungi that will proliferate in a hydrophilic colloid layer, to deteriorate an image, preferably mildew-proofing agents, as described in JP-A No. 271247/1988, are added.

When the light-sensitive material of the present invention is subjected to printer exposure, it is preferable to use a band stop filter described in U.S. Pat. No. 4,880,726, by which light color-mixing is removed, to noticeably improve color reproduction.

Although the above various additives may be used in the light-sensitive material in the art, other various additives can also be used, depending on the purpose.

These additives are described in more detail in Research Disclosure Item 17643 (December 1978), Research Disclosure Item 18716 (November 1979), and Research Disclosure Item 307105 (November 1989); and the particular sections are summarized in a table given below.

| Additive | RD 17643 | RD 18716 | RD 307105 |
|---|---|---|---|
| 1 Chemical sensitizers | p. 23 | p. 648 (right column) | p. 996 |
| 2 Sensitivity-enhancing agents | — | p. 648 (right column) | — |
| 3 Spectral sensitizers and Supersensitizers | pp. 23–24 | pp. 648 (right column) –649 (right column) | pp. 996 (right column) –998 (right column) |
| 4 Brightening agents | p. 24 | — | p. 998 (right column) |
| 5 Antifogging agents and Stabilizers | pp. 24–25 | p. 649 (right column) | pp. 998 (right column) –1000 (right column) |
| 6 Light absorbers, Filter dyes, and UV Absorbers | pp. 25–26 | pp. 649 (right column) –650 (left column) | p. 1003 (left to right column) |
| 7 Stain-preventing agents | p. 25 (right column) | p. 650 (left to right column) | — |
| 8 Image dye stabilizers | p. 25 | — | — |
| 9 Hardeners | p. 26 | p. 651 (left column) | pp. 1004 (right column) –1005 (left column) |
| 10 Binders | p. 26 | p. 651 (left column) | pp. 1003 (right column) –1004 (right column) |
| 11 Plasticizers and Lubricants | p. 27 | p. 650 (right column) | p. 1006 (left to right column) |
| 12 Coating aids and Surface-active agents | pp. 26–27 | p. 650 (right column) | pp. 1005 (left column) –1006 (left column) |
| 13 Antistatic agents | p. 27 | p. 650 (right column) | pp. 1006 (right column) –1007 (left column) |

As the total coated amount of silver in the light-sensitive material of the present invention, preferably 0.003 to 12 g per $m^2$ in terms of silver is used, in view of achieving the more rapid processing by omitting desilvering process, and the reduction of loading of waste solutions. The coated amount of silver in each layer is preferably 0.001 to 0.4 g per light-sensitive layer. In particular, when the light-sensitive material of the present invention is intensified, the amount is preferably 0.003 to 0.3 g, more preferably 0.01 to 0.1 g, and particularly preferably 0.015 to 0.05 g. In this case, the amount per light-sensitive layer is preferably 0.001 to 0.1 g, and more preferably 0.003 to 0.03 g.

In the present invention, if the coated amount of silver of each light-sensitive layer is too small, the dissolution of the silver salt proceeds, and therefore a satisfactory color density cannot be obtained. On the other hand, when intensification is carried out, if the coated amount of silver of each light-sensitive layer is too large, an increase in $D_{min}$ or formation of bubbles occurs, to make the appreciation of the resultant product difficult.

The light-sensitive material of the present invention is used in a print system using usual negative printers, and also it is preferably used for digital scanning exposure that uses monochromatic high-density light, such as a second harmonic generating light source (SHG) that comprises a combination of a nonlinear optical crystal with a semiconductor laser or a solid state laser using a semiconductor laser as an excitation light source, a gas laser, a light-emitting diode, or a semiconductor laser. To make the system compact and inexpensive, it is preferable to use a semiconductor laser or a second harmonic generating light source (SHG) that comprises a combination of a nonlinear optical crystal with a semiconductor laser or a solid state laser. Particularly, to design an apparatus that is compact, inexpensive, long in life, and high in stability, the use of a semiconductor laser is preferable, and it is desired to use a semiconductor laser for at least one of the exposure light sources.

If such a scanning exposure light source is used, the spectral sensitivity maximum of the light-sensitive material of the present invention can arbitrarily be set by the wavelength of the light source for the scanning exposure to be used. In an SHG light source obtained by combining a nonlinear optical crystal with a semiconductor laser or a solid state laser that uses a semiconductor laser as an excitation light source, since the emitting wavelength of the laser can be halved, blue light and green light can be obtained. Therefore, the spectral sensitivity maximum of the light-sensitive material can be present in each of the usual three regions, the blue region, the green region and the red region. In order to use a semiconductor laser as a light source to make the apparatus inexpensive, high in stability, and compact, preferably each of at least two layers has a spectral sensitivity maximum at 670 nm or over. This is because the emitting wavelength range of the available, inexpensive, and stable III-V group semiconductor laser is present now only in from the red region to the infrared region. However, on the laboratory level, the oscillation of a II-VI group semiconductor laser in the green or blue region is confirmed and it is highly expected that these semiconductor lasers can be used inexpensively and stably if production technique for the semiconductor lasers is developed. In that event, the necessity that each of at least two layers has a spectral sensitivity maximum at 670 nm or over becomes lower.

In such scanning exposure, the time for which the silver halide in the light-sensitive material is exposed is the time for which a certain very small area is required to be exposed. As the very small area, the minimum unit that controls the quantity of light from each digital data is generally used and is called a picture element. Therefore, the exposure time per picture element is changed depending on the size of the picture element. The size of the picture element is dependent on the density of the picture element, and the actual range is from 50 to 2,000 dpi. If the exposure time is defined as the time for which a picture size is exposed with the density of the picture element being 400 dpi, preferably the exposure time is $10^{-4}$ sec or less, more preferably $10^{-6}$ sec or less. The lower limit is not particularly restricted, but it is preferably $10^{-8}$ sec. More preferably, the exposure time per picture element is in a range between $10^{-8}$ to $10^{-4}$ sec.

Processing materials and processing methods used in the present invention will now be described.

In the present invention, the light-sensitive material is developed (silver development/cross oxidation of the built-in reducing agent), (desilvered), and washed with water or stabilized. In some cases, after the washing with water or the stabilizing processing, a treatment of alkalinization for color formation intensification is carried out.

When the light-sensitive material of the present invention is developed with a developing solution, preferably the developing solution contains a compound that serves as a developing agent of silver halides and/or allows the developing agent oxidation product resulting from the silver development to cross-oxidize the color-forming reducing agent built in the light-sensitive material. Preferably, pyrazolidones, dihydroxybenzenes, reductones, and aminophenols are used, and particularly preferably pyrazolidones are used.

Among pyrazolidones, 1-phenyl-3-pyrazolidones are preferable, and they include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-phenyl-5-phenyl-3-pyrazolidone, 1-p-tolyl-4-methyl-4-hydroxymethyl-3-pyrazolidone, 1-p-chlorophenyl-4-methyl-4-hydroxymethyl-3-pyrazolidone, 1-phenyl-2-hydroxymethyl-4,4-dimethyl-3-pyrazolidone, 1-phenyl-2-acetyl-3-pyrazolidone, and 1-phenyl-2-hydroxymethyl-5-phenyl-3-pyrazolidone.

Dihydroxybenzenes include hydroquinone, chlorohydroquinone, bromohydroquinone, isopropylhydroquinone, methylhydroquinone, 2,3-dichlorohydroquinone, 2,5-dichlorohydroquinone, 2,5-dimethylhydroquinone, and potassium hydroquinonemonosulfonate.

As reductones, ascorbic acid and its derivatives are preferable, and compounds described in JP-A No. 148822/1994, pages 3 to 10, can be used. In particular, sodium L-ascorbate and sodium erysorbate are preferable.

p-Aminophenols include N-methyl-p-aminophenol, N-(β-hydroxyethyl)-p-aminophenol, N-(4-hydroxyphenyl) glycine, and 2-methyl-p-aminophenol.

Although these compounds are generally used singly, use of two or more of them in combination is also preferable, to enhance the development and cross oxidation activity.

The amount of these compounds to be used in the developing solution is generally $2.5\times10^{-4}$ to 0.2 mol/liter, preferably 0.0025 to 0.1 mol/liter, and more preferably 0.001 to 0.05 mol/liter.

The developing solution used in the present invention preferably has a pH of 8 to 13, and more preferably 9 to 12.

To maintain the above pH, it is preferable to use various buffers. Further, in the developing solution, conventionally known agents can be added such as an organic preservatives, a development accelerator, a sediment-preventing agent, and a fluorescent whitening agent.

The processing temperature of the developing solution to be applied to the present invention is generally 20 to 50° C., and preferably 30 to 45° C. The processing time is generally 5 sec to 2 min, and preferably 10 sec to 1 min. With respect to the replenishing rate, although a small amount is preferable, the replenishing rate is generally 15 to 600 ml, preferably 25 to 200 ml, and more preferably 35 to 100 ml, per $m^2$ of the light-sensitive material.

After the development, a desilvering process can be carried out. The desilvering process comprises a fixing process, or both bleaching process and a fixing process. When both bleaching and fixing are carried out, the bleaching process and the fixing process may be carried out separately or simultaneously (bleach-fixing process). Also, according to the purpose, the processing may be carried out in a bleach-fixing bath having two successive tanks; or the fixing process may be carried out before the bleach-fixing process; or the bleaching process may be carried out after the bleach-fixing process. These bleach bath and fixing bath may be a known bath.

It is preferable to carry out the stabilizing process, to stabilize silver salts and dye images, without carrying out the desilvering process after the development.

After the development, image-intensifying process (intensification) can be performed using peroxides, halorous acids, iodoso compounds, and cobalt(III) complex compounds described, for example, in West Germany Patent (OLS) Nos. 1,813,920, 2,044,993, and 2,735,262, and JP-A Nos. 9728/1973, 84240/1974, 102314/1974, 53826/1976, 13336/1977, and 73731/1977. To further intensify the image, an oxidizing agent for intensifying the image can be added to the above developer, so that the development and the intensification may be carried out at the same time in one bath. In particular, hydrogen peroxide is preferable, because the amplification rate is high. These intensification methods are preferable processing methods in view of environmental conservation. This is because the amount of silver in the light-sensitive material can be reduced considerably, and therefore, for example, a bleaching process is not required and silver (or silver salts) will not be released, for example, by a stabilizing process or the like.

The processing temperature of the desilvering step is generally 20 to 50° C., and preferably 30 to 45° C. The processing time is generally 5 sec to 2 min, and preferably 10 sec to 1 min. Although a small replenishing rate is preferable, the replenishing rate is generally 15 to 600 ml, preferably 25 to 200 ml, and more preferably 35 to 100 ml, per $m^2$ of the light-sensitive material. The processing is also preferably carried out without replenishment in such a way that the evaporated amount is supplemented with water.

The light-sensitive material of the present invention is generally passed through a washing step after the desilvering process. If a stabilizing process is carried out, the washing step can be omitted. The pH of the washing water and the stabilizing solution is generally 4 to 9, and preferably 5 to 8. The processing temperature is generally 15 to 45° C., and preferably 25 to 40° C. The processing time is generally 5 sec to 2 min, and preferably 10 sec to 40 sec.

The overflow solution associated with the replenishment of the above washing water and/or the stabilizing solution, can be reused in other processes, such as the desilvering process.

The amount of the washing water and/or the stabilizing solution can be set in a wide range depending on various conditions, and the replenishing rate is preferably 15 to 360 ml, and more preferably 25 to 120 ml, per $m^2$ of the light-sensitive material.

The processing time in each process according to the present invention means the time required from the start of the processing of the light-sensitive material at any process, to the start of the processing in the next process. The actual processing time in an automatic developing machine is determined generally by the linear speed and the volume of the processing bath, and in the present invention, as the linear speed, 500 to 4,000 mm/min can be mentioned as a guide. Particularly in the case of a small-sized developing machine, 500 to 2,500 mm/min is preferable.

The processing time in the whole processing steps, that is, the processing time from the developing process to the drying process, is preferably 360 sec or below, more preferably 120 sec or below, and particularly preferably 90 to 30 sec. Herein the processing time means the time from the dipping of the light-sensitive material into the developing solution, till the emergence from the drying part of the processor.

According to the present invention, a silver halide color light-sensitive material can be obtained that makes low-replenishing and low-discharging processing possible, and that exhibits good color reproducibility and good color-forming property. By using the light-sensitive material of the present invention, with only a small amount of silver applied, the desilvering process can be omitted.

EXAMPLES

The present invention will now be described specifically with reference to the examples, but of course the present invention is not limited to them.

Example 1

A paper base, both surfaces of which had been laminated with a polyethylene, was subjected to surface corona discharge treatment; then it was provided with a gelatin undercoat layer containing sodium dodecylbenzensulfonate, and it was coated with two photographic constitutional layers, to produce a photographic printing paper, Sample (100), having the two-layer constitution shown below. The coating solutions were prepared as follows.

First-Layer Coating Solution 18.5 g of a coupler (ExM-1), 20 g of a reducing agent for color formation (I-9), and 80 g of a solvent (Solv-2) were dissolved in 100 ml of ethyl acetate, and the resulting solution was emulsified and dispersed into 270 g of 16%-aqueous gelatin solution containing 16 m of 10%-sodium dodecylbenzensulfonate and 0.4 g of citric acid, to prepare an emulsified dispersion B. On the other hand, a silver chlorobromide emulsion B (cubes, a mixture of a large-size emulsion having an average grain size of 0.55 $\mu$m, and a small-size emulsion having an average grain size of 0.39 $\mu$m (1:3 in terms of mol of silver), the deviation coefficients of the grain size distributions being 0.10 and 0.08, respectively, and each emulsion having 0.8 mol % of silver bromide locally contained in part of the grain surface whose substrate was made up of silver chloride) was prepared. To the large-size emulsion of this emulsion, had been added $3.0\times10^{-4}$ mol, $4.0\times10^{-5}$ mol, and $2.0\times10^{-4}$ mol, per mol of silver, respectively, of green-sensitive sensitizing dyes D, E, and F shown below, and to the small-size emulsion of this emulsion, had been added $3.6\times10^{-4}$ mol, $7.0\times10^{-5}$ mol, and $2.8\times10^{-4}$ mol, per mol of silver, respectively, of green-sensitive sensitizing dyes D, E, and F shown below. The chemical ripening of this emulsion was carried out optimally with a sulfur sensitizer and a gold sensitizer being added. The above emulsified dispersion B and this silver chlorobromide emulsion B were mixed and dissolved, and a first-layer coating solution was prepared so that it would have the composition shown below. The coating amount of the emulsion is in terms of silver.

In the similar way as the method of preparing the first-layer coating solution, a coating solution for the second layer was prepared. As the gelatin hardener for each layer, 1-oxy-3,5-dichloro-s-triazine sodium salt was used.

Further, to each layer, were added Cpd-2, Cpd-3, Cpd-4, and Cpd-5, so that the total amounts would be 15.0 mg/m$^2$, 60.0 mg/m$^2$, 50.0 mg/m$^2$, and 10.0 mg/m$^2$, respectively.

For the silver chlorobromide emulsion of the first layer, the following spectral sensitizing dyes were used.

Sensitizing dye D

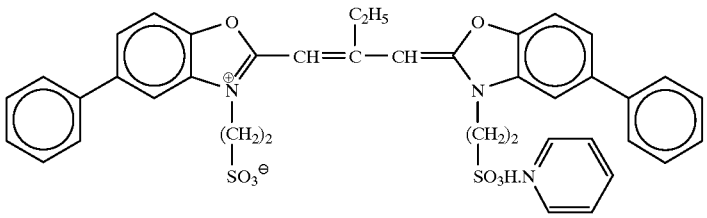

Sensitizing dye E

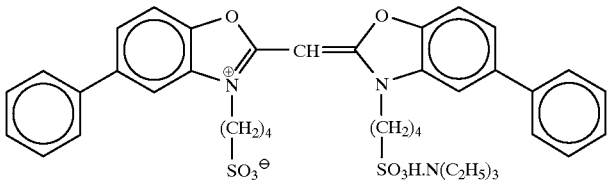

Sensitizing dye F

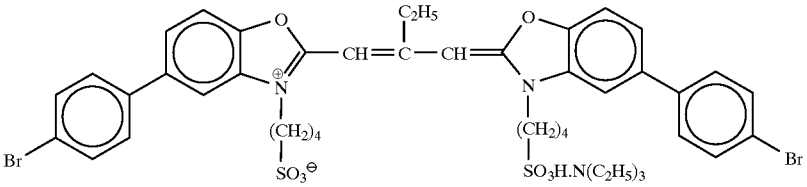

(Layer Constitution)

The composition of each layer is shown below. The numbers show coating amounts (g/m$^2$). In the case of the silver halide emulsion, the coating amount is in terms of silver.

Base

Polyethylene-Laminated Paper [The polyethylene on the first layer side contained a white pigment ($TiO_2$) and a blue dye (ultramarine)]

First Layer

| | |
|---|---|
| The above silver chlorobromide emulsion B | 0.20 |
| Gelatin | 1.50 |
| Magenta coupler (ExM-1) | 0.185 |
| Reducing agent for color formation (I-9) | 0.20 |
| Solvent (Solv-2) | 0.80 |

Second Layer (protective layer)

| | |
|---|---|
| Gelatin | 1.01 |
| Acryl-modified copolymer of polyvinyl alcohol (modification degree: 17%) | 0.04 |
| Liquid paraffin | 0.02 |
| Surface-active agent (Cpd-1) | 0.01 |

Samples (101) to (133) were prepared in the same manner as Sample (100), except that, in the coating solution of the first layer, the magenta coupler and the reducing agent for color formation were changed to the magenta coupler and the reducing agent for color formation, in the same molar amounts, shown in Table 1.

(ExM-1)

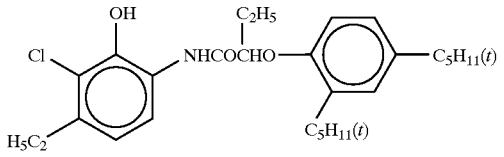

-continued (ExM-2)

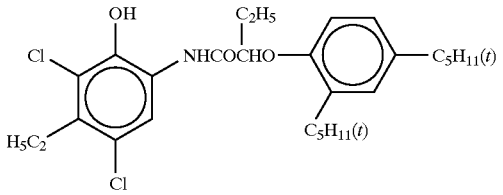

(Cpd-1) Surface-active agent
7:3 mixture (by weight ratio) of

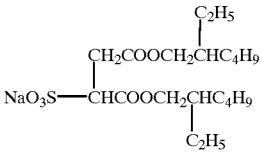

and

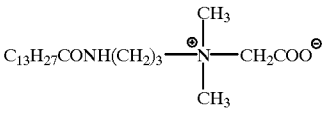

(Cpd-2) Antiseptic (Cpd-3) Antiseptic

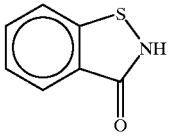

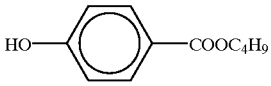

(Cpd-4) Antiseptic
1:1:1:1 mixture of a, b, c, d

| | $R^1$ | $R^2$ |
|---|---|---|
| a | —Me | —NHMe |
| b | —Me | —$NH_2$ |
| c | —H | —$NH_2$ |
| d | —H | —NHMe |

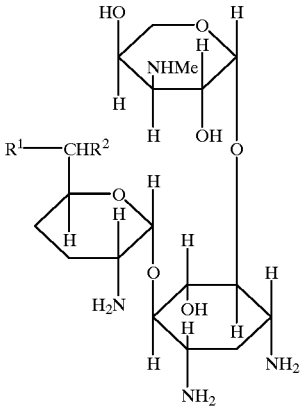

(Cpd-5) Antiseptic

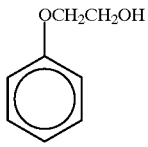

(Solv-1) Solvent

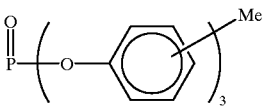

(Solv-2) Solvent

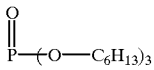

Using an FWH-type sensitometer (color temperature of the light source: 3,200° K.), manufactured by Fuji Photo Film Co., Ltd., gradation exposure was given to the thus prepared Samples (100) to (133) through a green filter for sensitometry.

The thus light-exposed Samples were processed with the following processing solutions in the following processing steps.

Processing step

| Processing step | Temperature | Time |
|---|---|---|
| Development | 40° C. | 15 sec |
| Bleach-fix | 40° C. | 45 sec |
| Rinse | room temperature | 45 sec |
| Alkali treatment | room temperature | 30 sec |

Developing Solution

| | |
|---|---|
| Water | 800 ml |
| Potassium phosphate | 40 g |
| Disodium-N,N-bis(sulfonatoethyl)hydroxylamine | 10 g |
| KCl | 5 g |
| Hydroxylethylidene-1,1-diphosphonic acid (30%) | 4 ml |

-continued

| | |
|---|---|
| 1-Phenyl-4-methyl-4-hydroxymethyl-3-pyrazolidone | 1 g |
| Water to make | 1,000 ml |
| pH (at 25° C. by using potassium hydroxide) | 12 |

Bleach-fix Solution

| | |
|---|---|
| Water | 600 ml |
| Ammonium thiosulfate (700 g/liter) | 93 ml |
| Ammonium sulfite | 40 ml |
| Ethylenediaminetetraacetic acid iron(III) ammonium salt | 55 g |
| Ethylenediaminetetraacetic acid | 2 g |
| Nitric acid (67%) | 30 g |
| Water to make | 1,000 ml |
| pH (at 25° C. by using acetic acid and ammonia water) | 5.8 |

Rinsing Solution

| | |
|---|---|
| Sodium chlorinated-isocyanurate | 0.02 g |
| Deionized water (electric conductivity: 5 μS/cm or below) | 1,000 ml |
| pH | 6.5 |
| Alkali Treatment Solution | |
| Water | 800 ml |
| Potassium carbonate | 30 g |
| Water to make | 1,000 ml |
| pH (at 25° C. by using sulfuric acid) | 10.0 |

The maximum color density (Dmax) part of the processed Samples was measured using green light. The results are shown in Table 1.

TABLE 1

| Sample No. | Reducing agent for color formation | Coupler | Dmax | Remarks |
|---|---|---|---|---|
| 100 | I-9 | ExM-1 | 0.30 | Comparative example |
| 101 | " | ExM-2 | 0.25 | " |
| 102 | " | C-1 | 1.45 | This invention |
| 103 | " | C-6 | 1.43 | " |
| 104 | " | C-9 | 1.62 | " |
| 105 | " | C-13 | 0.66 | " |
| 106 | I-56 | ExM-1 | 0.33 | Comparative example |
| 107 | " | ExM-2 | 0.26 | " |
| 108 | " | C-1 | 1.53 | This invention |
| 109 | " | C-6 | 1.55 | " |
| 110 | " | C-9 | 1.72 | " |
| 111 | " | C-13 | 0.68 | " |
| 112 | I-5 | ExM-1 | 0.30 | Comparative example |
| 113 | " | C-1 | 1.25 | This invention |
| 114 | " | C-3 | 1.22 | " |
| 115 | " | C-6 | 1.36 | " |
| 116 | I-38 | ExM-1 | 0.26 | Comparative example |
| 117 | " | C-1 | 0.37 | This invention |
| 118 | I-11 | ExM-1 | 0.29 | Comparative example |
| 119 | " | C-1 | 1.32 | This invention |
| 120 | I-20 | ExM-1 | 0.26 | Comparative example |
| 121 | I-20 | C-1 | 0.35 | This invention |
| 122 | I-54 | ExM-1 | 0.32 | Comparative example |
| 123 | " | C-1 | 1.52 | This invention |
| 124 | I-55 | ExM-1 | 0.32 | Comparative example |
| 125 | " | C-1 | 1.51 | This invention |
| 126 | I-63 | ExM-2 | 0.32 | Comparative example |
| 127 | " | C-10 | 1.86 | This invention |
| 128 | I-78 | ExM-2 | 0.34 | Comparative example |
| 129 | " | C-2 | 1.58 | This invention |
| 130 | " | C-7 | 1.72 | " |
| 131 | " | C-10 | 2.22 | " |
| 132 | I-86 | ExM-2 | 0.40 | Comparative example |
| 133 | " | C-10 | 2.18 | This invention |

As is apparent from the results shown in Table 1, it can be understood that the samples wherein a phenol coupler for use in the present invention was used showed higher color densities than those of the samples wherein a comparative phenol couplers was used. Further, it can be understood that when Reducing agent for color formation (I-9) represented by formula (IV) was used, the color-forming property was even higher than other results of the present invention. Further, it can be seen that when Reducing agent for color formation (I-56) represented by formula (V) was used, the color-forming property was even higher.

Example 2

Samples (200) to (226) were prepared in the same manner as in Sample (100) in Example 1, except that, in the coating solution of the first layer, the silver chlorobromide emulsion B was changed to the following silver chlorobromide emulsion C, in the same amount of silver, and the coupler and the reducing agent for color formation were respectively changed to the cyan coupler and the reducing agent for color formation, in the same molar amounts, shown in Table 2. (However, as a solvent, Solv-1 was used except for Solv-2.)

A silver chlorobromide emulsion C: cubes, a mixture of a large-size emulsion C having an average grain size of 0.5 μm, and a small-size emulsion C having an average grain size of 0.41 μm (1:4 in terms of mol of silver). The deviation coefficients of the grain size distributions were 0.09 and 0.11, respectively, and each emulsion had 0.8 mol % of AgBr locally contained in part of the grain surface whose substrate was made up of silver chloride.

For the silver chlorobromide emulsion C, the following spectral sensitizing dyes G and H were used respectively:

Sensitizing dye G

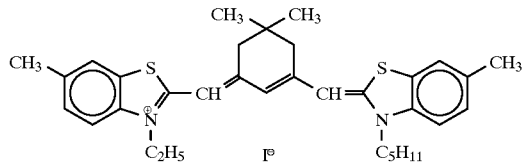

Sensitizing dye H

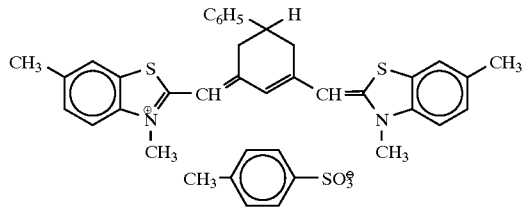

(Each was added to the large-size emulsion in an amount of $5.0\times10^{-5}$ mol per mol of the silver halide, and to the small-size emulsion in an amount of $8.0\times10^{-5}$ mol per mol of the silver halide.)

(E x C-1) (Naphthol coupler for comparison)

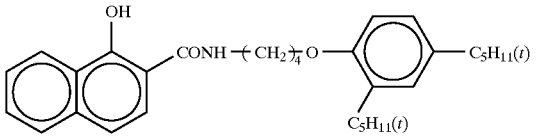

Using an FWH-type sensitometer (color temperature of the light source: 3,200° K.), manufactured by Fuji Photo Film Co., Ltd., exposure was given to the thus prepared Samples (200) to (226) with green light so as to obtain color density 0.5.

For the thus exposed Samples, the processing was carried out in the same manner in Example 1.

Reflection spectrum of all processed samples was measured, and maximum absorbed wavelength (max) was read from the spectrum. The results are shown in Table 2.

TABLE 2

| Sample No. | Reducing agent for color formation | Coupler | Dmax | Remarks |
|---|---|---|---|---|
| 200 | I-9 | ExC-1 | 561 nm | Comparative example |
| 201 | " | N-17 | 618 | This invention |
| 202 | " | N-18 | 617 | " |
| 203 | " | N-8 | 618 | " |
| 204 | " | N-19 | 618 | " |
| 205 | " | N-20 | 617 | " |
| 206 | I-56 | ExC-I | 626 | Comparative example |
| 207 | " | N-17 | 637 | This invention |
| 208 | " | N-18 | 645 | " |
| 209 | " | N-8 | 638 | " |
| 210 | " | N-19 | 638 | " |
| 211 | " | N-20 | 645 | " |
| 212 | I-38 | ExC-1 | 626 | Comparative example |
| 213 | " | N-17 | 637 | This invention |
| 214 | " | N-18 | 645 | " |
| 215 | " | N-8 | 638 | " |
| 216 | " | N-19 | 638 | " |
| 217 | " | N-20 | 645 | " |
| 218 | I-63 | ExC-2 | 626 | Comparative example |
| 219 | " | N-19 | 638 | This invention |
| 220 | " | N-20 | 645 | " |
| 221 | I-78 | ExC-2 | 561 | Comparative example |
| 222 | " | N-19 | 618 | This invention |
| 223 | " | N-20 | 617 | " |
| 224 | I-86 | ExC-2 | 561 | Comparative example |
| 225 | " | N-19 | 618 | This invention |
| 226 | " | N-20 | 617 | " |

As is apparent from the results shown in Table 2, it can be found that in the samples wherein a naphthol coupler for use in the present invention was used, the wavelength of the maximum absorption of the color-formed dye was present at a longer wavelength region in comparison with the samples wherein a naphthol coupler for comparison was used. This means that a great improvement in color reproducibility of natural color has been made.

With respect to Reducing agents for color formation (I-5), (I-11), (I-20), (I-54), and (I-55), the similar effect was observed by using couplers for use in the present invention.

Example 3

Samples (300) to (329) were prepared in the same manner as in Sample (100), except that, in the coating solution of the first layer for Sample (200) in Example 2, the coupler and the reducing agent for color formation were respectively changed to the cyan coupler and the reducing agent for color formation, in the same molar amounts, shown in Table 3.

Using an FWH-type sensitometer (color temperature of the light source: 3,200° K.), manufactured by Fuji Photo Film Co., Ltd., gradation exposure was given to the thus prepared Samples (300) to (329) through a red filter for sensitometry.

For the thus exposed Samples, the processing was carried out in the same manner in Example 1.

The maximum color density (Dmax) part of the processed Samples was measured using red light The results are shown in Table 3.

TABLE 3

| Sample No. | Reducing agent for color formation | Coupler | Dmax | Remarks |
|---|---|---|---|---|
| 300 | I-9 | ExC-1 | 0.52 | Comparative example |
| 301 | " | N-17 | 1.68 | This invention |
| 302 | " | N-8 | 1.67 | " |
| 303 | " | N-1 | 1.65 | " |
| 304 | " | N-4 | 1.65 | " |
| 305 | I-38 | ExC-1 | 0.42 | Comparative example |
| 306 | " | N-17 | 0.48 | This invention |
| 307 | " | N-8 | 0.52 | " |
| 308 | " | N-1 | 0.50 | " |
| 309 | " | N-4 | 0.51 | " |
| 310 | I-56 | ExC-1 | 1.74 | Comparative example |
| 311 | " | N-17 | 1.72 | This invention |
| 312 | " | N-8 | 0.73 | " |
| 313 | " | N-1 | 1.74 | " |
| 314 | " | N-4 | 1.72 | " |
| 315 | I-5 | ExC-1 | 0.50 | Comparative example |
| 316 | " | N-8 | 1.69 | This invention |
| 317 | I-54 | ExC-1 | 0.76 | Comparative example |
| 318 | " | N-8 | 1.74 | This invention |
| 319 | I-20 | ExC-1 | 0.42 | Comparative example |
| 320 | " | N-8 | 0.50 | This invention |
| 321 | I-63 | ExC-2 | 0.79 | Comparative example |
| 322 | " | N-19 | 1.83 | This invention |
| 323 | " | N-20 | 1.85 | " |
| 324 | I-78 | ExC-2 | 0.62 | Comparative example |
| 325 | " | N-19 | 1.84 | This invention |
| 326 | " | N-20 | 1.85 | " |
| 327 | I-86 | ExC-2 | 0.60 | Comparative example |
| 328 | " | N-19 | 1.82 | This invention |
| 329 | " | N-20 | 1.82 | " |

As is apparent from the results shown in Table 3, it can be seen that when a naphthol coupler for use in the present invention was used, use of Reducing agent for color formation (I-9) represented by formula (IV-a) resulted in even higher color-forming property than other results of the present invention. It can also be understood that when Reducing agent for color formation (I-56) represented by formula (V) was used, the color-forming property was even higher.

Example 4

A polyethylene laminated paper base which had been subjected to surface treatment and provided with undercoat layer as described in Example 1, and it was coated with various photographic constitutional layers, to produce a multi-layer photographic color printing paper, Sample (400), having the layer constitution shown below.

First-Layer Coating Solution 17 g of a coupler (ExY-1), 20 g of a reducing agent for color formation (I-9), and 80 g of a solvent (Solv-1) were dissolved in 100 ml of ethyl acetate, and the resulting solution was emulsified and dispersed into 270 g of a 16%-aqueous gelatin solution containing 16 ml of 10% sodium dodecylbenzensulfonate and 0.4 g of citric acid, to prepare an emulsified dispersion A. On the other hand, a silver chlorobromide emulsion A (cubes, a mixture of a large-size emulsion having an average grain size of 0.88 μm, and a small-size emulsion having an average grain size of 0.70 μm (3:7 in terms of mol of silver), the deviation coefficients of the grain size distributions being 0.08 and 0.10, respectively, and each emulsion having 0.3 mol % of silver bromide locally contained in part of the grain surface whose substrate was made up of silver chloride) was prepared. To the large-size emulsion of this emulsion, had been added $1.4\times10^{-4}$ mol. per mol of silver, of each of blue-sensitive sensitizing dyes A, B, and C shown below, and to the small-size emulsion of this emulsion, had been added $1.7\times10^{-4}$ mol, per mol of silver, of each of blue-sensitive sensitizing dyes A, B, and C shown below. The chemical ripening of this emulsion was carried out with a sulfur sensitizer and a gold sensitizer being added. The above emulsified dispersion A and this silver chlorobromide emulsion A were mixed and dissolved, and a first-layer coating solution was prepared so that it would have the composition shown below. The coating amount of the emulsion is in terms of silver.

Sensitizing dye A

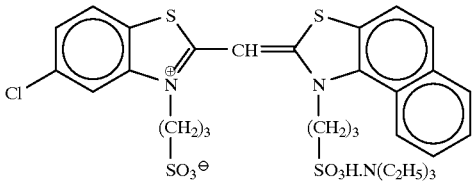

Sensitizing dye B

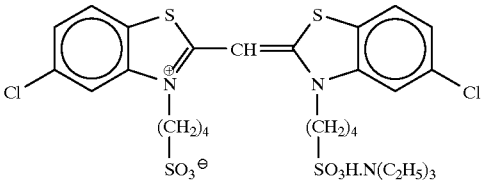

Sensitizing dye C

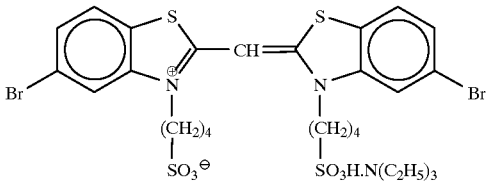

The coating solution for the third layer used in Example 1, and the coating solution for the fifth layer used in Example 2 were used.

In the similar way as the method of preparing the first-layer coating solution, coating solutions for the second layer to the seventh layer were prepared. As the gelatin hardeners for each layers, 1-oxy-3,5-dichloro-s-triazine sodium salt was used.

Further, to each layer, were added same four antiseptics used in Example 1, respectively, with the same amounts.

Further, the following compound was added to the fifth layer (the red-sensitive layer) in an amount of $2.6\times10^{-2}$ mol per mol of the silver halide.

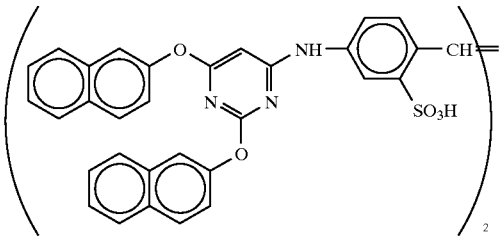

To the blue-sensitive emulsion layer, the green-sensitive emulsion layer, and the red-sensitive emulsion layer, was added 1-(5-methylureidophenyl)-5-mercaptotetrazole in amounts of $3.5\times10^{-4}$ mol, $3.0\times10^{-3}$ mol, and $2.5\times10^{-4}$ mol, respectively, per mol of the silver halide.

Further, to the blue-sensitive emulsion layer and the green-sensitive emulsion layer, were added 4-hydroxy-6-methyl-1,3,3a,7-tetrazaindene in amounts of $1\times10^{-4}$ mol and $2\times10^{-4}$ mol, respectively, per mol of the silver halide.

Further, to prevent irradiation, the following dyes were added to the emulsion layers (the coating amount is shown in parentheses).

(10mg/m²)

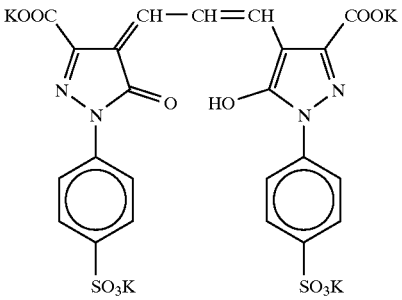

-continued and

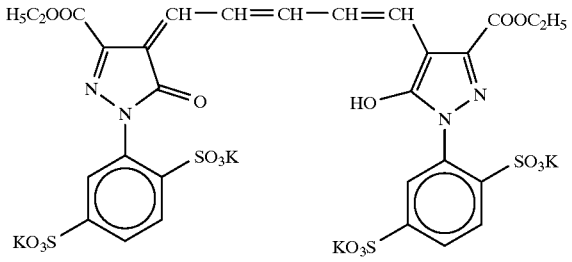

(40mg/m$^2$)

(Layer Constitution)

The composition of each layer is shown below. The numbers show coating amounts (g/m$^2$). In the case of the silver halide emulsion, the coating amount is in terms of silver.

Base

Polyethylene-Laminated Paper [The polyethylene on the first layer side contained a white pigment ($TiO_2$) and a blue dye (ultramarine)]

First Layer (Blue-Sensitive Emulsion Layer)

| | |
|---|---|
| The above silver chlorobromide emulsion A | 0.20 |
| Gelatin | 1.50 |
| Yellow coupler (ExY-1) | 0.17 |
| Reducing agent for color formation (I-9) | 0.20 |
| Solvent (Solv-1) | 0.80 |

Second Layer (Color-Mixing Inhibiting Layer)

| | |
|---|---|
| Gelatin | 1.09 |
| Color-mixing inhibitor (Cpd-6) | 0.11 |
| Solvent (Solv-1) | 0.19 |
| Solvent (Solv-3) | 0.07 |
| Solvent (Solv-4) | 0.25 |
| Solvent (Solv-5) | 0.09 |

Third Layer (Green-Sensitive Emulsion Layer)

| | |
|---|---|
| The silver chlorobromide emulsion B in Example 1 | 0.20 |
| Gelatin | 1.50 |
| Magenta coupler (ExM-1) | 0.24 |
| Reducing agent for color formation (I-9) | 0.20 |
| Solvent (Solv-2) | 0.80 |

Fourth Layer (Color-Mixing Inhibiting Layer)

| | |
|---|---|
| Gelatin | 0.77 |
| Color-mixing inhibitor (Cpd-6) | 0.08 |
| Solvent (Solv-1) | 0.14 |
| Solvent (Solv-3) | 0.05 |
| Solvent (Solv-4) | 0.14 |
| Solvent (Solv-5) | 0.06 |

Fifth Layer (Red-Sensitive Emulsion Layer)

| | |
|---|---|
| The silver chlorobromide emulsion C in Example 2 | 0.20 |
| Gelatin | 1.50 |
| Cyan coupler (ExC-1) | 0.20 |
| Reducing agent for color formation (I-9) | 0.20 |
| Solvent (Solv-1) | 0.18 |

Sixth Layer (Ultraviolet Absorbing Layer)

| | |
|---|---|
| Gelatin | 0.64 |
| Ultraviolet absorbing agent (UV-1) | 0.39 |
| Color image stabilizer (Cpd-7) | 0.05 |
| Solvent (Solv-6) | 0.05 |

Seventh Layer (Protective Layer)

| | |
|---|---|
| Gelatin | 1.01 |
| Acryl modified copolymer of polyvinyl alcohol (modification degree: 17%) | 0.04 |
| Liquid paraffin | 0.02 |
| Surface-active agent (Cpd-1) | 0.01 |

(ExY-1)
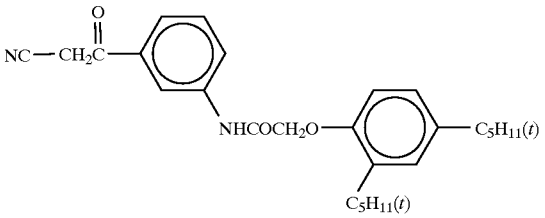
(Cpd-6) Color-mixing inhibitor
mixture (by weight ratio) of (1):(2):(3) = 1:1:1
(1)
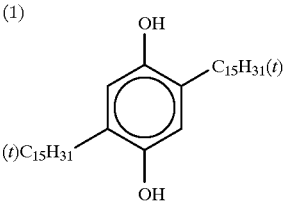
(2)
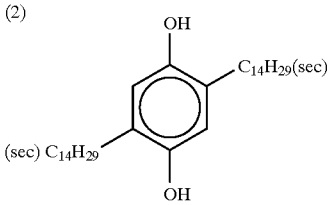
(3)
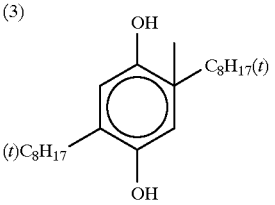
(Cpd-7) Color-image stabilizer
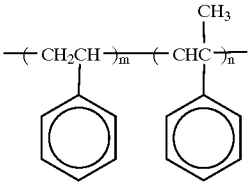
number-average
molecular weight 600
m/n=9/1
(Solv-3) Solvent
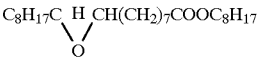
(Solv-4) Solvent
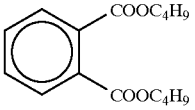
(Solv-5) Solvent
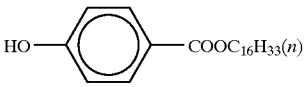
(Solv-6) Solvent
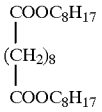
(UV-1) Ultraviolet absorbent
mixture (by weight ratio) of
(1):(2):(3):(4):(5) = 1:2:2:3:1
(1)
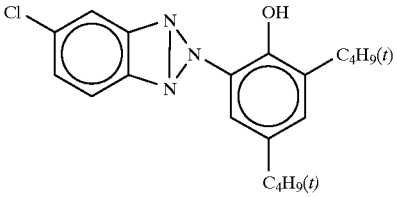
(2)
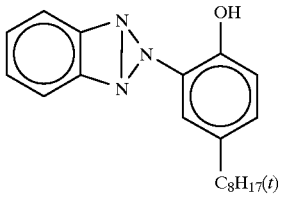

-continued (3)

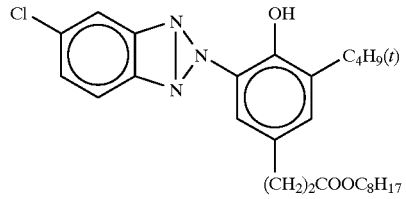

(4)

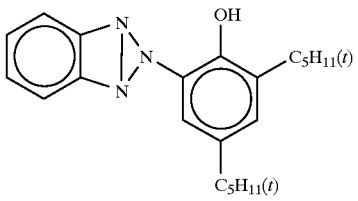

(5)

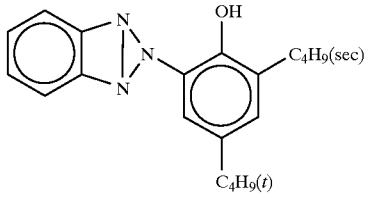

Samples (401) to (405) were prepared in the same manner as in Sample (400), except that instead of the reducing agent for color formation, the magenta coupler, and the cyan coupler, which were used in Sample (400), the reducing agents for color formation, the magenta couplers, and the cyan couplers, shown in Table 4, were used.

By using an FWH-type sensitometer (color temperature of the light source: 3,200° K.), manufactured by Fuji Photo Film Co., Ltd., gradation exposure was given to all of the thus prepared Samples through a three-color separation filter for sensitometry.

The thus exposed Samples were processed with the following processing solutions in the following processing steps.

| Processing step | Temperature | Time |
|---|---|---|
| Development | 40° C. | 15 sec |
| Bleach-fix | 40° C. | 45 sec |
| Rinse | room temperature | 45 sec |
| Alkali treatment | room temperature | 30 sec |

Developing Solution

| | |
|---|---|
| Water | 800 ml |
| Potassium phosphate | 40 g |
| Disodium-N,N-bis(sulfonatoethyl)hydroxylamine | 10 g |
| KCl | 5 g |
| Hydroxylethylidene-1,1-diphosphonic acid (30%) | 4 ml |
| 1-Phenyl-4-methyl-4-hydroxymethyl-3-pyrazolidone | 1 g |
| Water to make | 1,000 ml |
| pH (at 25° C. by using potassium hydroxide) | 12 |

Bleach-fix Solution

| | |
|---|---|
| Water | 600 ml |
| Ammonium thiosulfate (700 g/liter) | 93 ml |
| Ammonium sulfite | 40 g |
| Ethylenediaminetetraacetic acid iron (III) ammonium | 55 g |
| Ethylenediaminetetraacetic acid | 2 g |
| Nitric acid (67%) | 30 g |
| Water to make | 1,000 ml |
| pH (at 25° C. by using acetic acid and aqueous ammonia) | 5.8 |

Rinsing Solution

| | |
|---|---|
| Sodium chlorinated isocyanurate | 0.02 g |
| Deionized water (conductivity: 5 μS/cm or below) | 1,000 ml |
| pH | 6.5 |
| Alkali Treatment Solution | |
| Water | 800 ml |
| Potassium carbonate | 30 g |
| Water to make | 1,000 ml |
| pH (at 25° C. by using sulfuric acid) | 10.0 |

The maximum color density (Dmax) parts of magenta color part and cyan color part of the processed Samples were measured using green light and red light, respectively. The results are shown in Table 4.

TABLE 4

| Sample No. | Reducing agent for color formation | Magenta coupler | Cyan coupler | Magenta Dmax | Cyan Dmax | Cyan λmax | Remarks |
|---|---|---|---|---|---|---|---|
| 400 | I - 9 | ExM-1 | ExC-1 | 0.42 | 0.60 | 561 | Comparative example |
| 401 | " | C-1 | N-8 | 1.52 | 1.74 | 618 | This invention |
| 402 | " | C-13 | N-18 | 1.67 | 1.73 | 617 | This invention |
| 403 | I - 56 | ExM-1 | ExC-1 | 0.42 | 1.74 | 626 | Comparative example |
| 404 | " | C-1 | N-8 | 1.65 | 1.79 | 638 | This invention |
| 405 | " | C-13 | N-18 | 1.79 | 1.76 | 645 | This invention |

Further, using an FWH-type sensitometer (color temperature of the light source: 3,200° K.), manufactured by Fuji Photo Film Co., Ltd., exposure was given to the Samples (400) to (405) with red light so as to obtain cyan-color density 0.5.

For all of the thus exposed Samples, the processing was carried out in the same manner as described above.

Reflection spectrum of all processed Samples was measured, and maximum absorbed wavelength (λmax) in cyan-color formation was read from the spectrum. The results are shown in Table 4.

As is apparent from the results shown in Table 4, similar results as single-layered light-sensitive materials shown in Examples 1 to 3, were obtained with multi-layered light-sensitive materials.

Example 5

A paper base, both surfaces of which had been laminated with a polyethylene, was subjected to surface corona discharge treatment; then it was provided with a gelatin undercoat layer containing sodium dodecylbenzensulfonate, and it was coated with various photographic constitutional layers, to produce a multi-layer photographic color printing paper (500) having the layer constitution shown below. The coating solutions were prepared as follows.

Third-layer Coating Solution 19.7 g of a coupler (ExM-2), 21.1 g of a reducing agent for color formation (I-78), and 80 g of a solvent (Solv-1) were dissolved in ethyl acetate, and the resulting solution was emulsified and dispersed into 400 g of a 16% gelatin solution containing 10% sodium dodecylbenzensulfonate and citric acid, to prepare an emulsified dispersion E. On the other hand, a silver chlorobromide emulsion E (cubes, a mixture of a large-size emulsion E having an average grain size of 0.10 $\mu$m, and a small-size emulsion E having an average grain size of 0.08 $\mu$m (1:3 in terms of mol of silver), the deviation coefficients of the grain size distributions being 0.10 and 0.08, respectively, and each emulsion having 0.8 mol % of silver bromide locally contained in part of the grain surface whose substrate was made up of silver chloride) was prepared. To the large-size emulsion E of this emulsion, had been added $1.5\times10^{-3}$ mol, $2.0\times10^{-4}$ mol, and $1.0\times10^{-3}$ mol, per mol of silver halide, of each of said sensitizing dyes D, E, and F, respectively, and to the small-size emulsion E of this emulsion, had been added $1.8\times10^{-3}$ mol, $3.5\times10^{-4}$ mol, and $1.4\times10^{-3}$ mol, per mol of silver halide, of each of said sensitizing dyes D, E, and F, respectively. The chemical ripening of this emulsion was carried out with a sulfur sensitizer and a gold sensitizer being added. The above emulsified dispersion E and this silver chlorobromide emulsion E were mixed and dissolved, and a third-layer coating solution was prepared so that it would have the composition shown below. The coating amount of the emulsion is in terms of silver.

In the similar way as the method of preparing the third-layer coating solution, coating solutions for the first layer, the second layer, and the forth to seventh layers were prepared. As the gelatin hardeners for each layers, 1-oxy-3, 5-dichloro-s-triazine sodium salt was used.

Further, to each layer, were added Cpd-2, Cpd-3, Cpd-4, and Cpd-5, so that the total amounts would be 15.0 mg/m$^2$, 60.0 mg/m$^2$, 50.0 mg/m$^2$, and 10.0 mg/m$^2$, respectively.

To each of the blue-sensitive emulsion layer and the red-sensitive emulsion layer, the above blue-sensitive sensitizing dyes A, B, and C, and red-sensitive sensitizing dyes G and H were added in amounts as follows.

Blue-Sensitive Emulsion Layer (The blue-sensitive sensitizing dyes A, B, and C were added to the following large-size emulsion D in an amount of $7.0\times10^{-4}$ mol, per mol of silver halide, respectively, and to the following small-size emulsion D in an amount of $8.5\times10^{-4}$ mol, per mol of silver halide, respectively.)

Red-Sensitive Emulsion Layer (Each of the red-sensitive sensitizing dyes G and H, were added to the large-size emulsion F in an amount of $2.5\times10^{-4}$ mol, per mol of the silver halide, to the small-size emulsion F in an amount of $4.0\times10^{-4}$ mol, per mol of the silver halide.)

Further, the same compound used in Example 4 was added to the fifth layer (the red-sensitive emulsion layer) in an amount of $2.6\times10^{-2}$ mol per mol of the silver halide.

To the blue-sensitive emulsion layer, the green-sensitive emulsion layer, and the red-sensitive emulsion layer, was added 1-(5-methylureidophenyl)-5-mercaptotetrazole in amounts of $3.5\times10^{-4}$ mol, $3.0\times10^{-3}$ mol, and $2.5\times10^{-4}$ mol, respectively, per mol of the silver halide.

Further, to the blue-sensitive emulsion layer and the green-sensitive emulsion layer, were added 4-hydroxy-6-methyl-1,3,3a,7-tetrazaindene in amounts of $1\times10^{-4}$ mol and $2\times10^{-4}$ mol, respectively, per mol of the silver halide. Further, the trimethineoxonol dye and the pentamethineoxonol dye, which were used in Example 4, were added, in the same amounts in Example 4.

The composition of each layer is shown below. The numbers show coating amounts (g/m$^2$). In the case of the silver halide emulsion, the coating amount is in terms of silver.

Base

Polyethylene-Laminated Paper [The polyethylene on the first layer side contained a white pigment ($TiO_2$: 15 wt %) and a blue dye (ultramarine)]

First Layer (Blue-Sensitive Emulsion Layer)

| | |
|---|---|
| A silver chlorobromide emulsion D | 0.01 |

(cubes, a mixture of a large-size emulsion D having an average grain size of 0.10 $\mu$m, and a small-size emulsion D having an average grain size of 0.08 $\mu$m (3:7 in terms of mol of silver). The deviation coefficients of the grain size distributions were 0.08 and 0.10, respectively, and each emulsion had 0.3 mol % of AgBr locally contained in part of the grain surface whose substrate was made up of silver chloride. The chemical ripening of this emulsion was carried out with a sulfur sensitizer and a gold sensitizer being added.)

| | |
|---|---|
| Gelatin | 1.50 |
| Yellow coupler (ExY-2) | 0.183 |
| Reducing agent for color formation (I-76) | 0.211 |
| Solvent (Solv-1) | 0.80 |

Second Layer (Color-Mixing Inhibiting Layer)

| | |
|---|---|
| Gelatin | 1.09 |
| Color-mixing inhibitor (Cpd-7) | 0.11 |
| Solvent (Solv-1) | 0.19 |
| Solvent (Solv-3) | 0.07 |
| Solvent (Solv-4) | 0.25 |
| Solvent (Solv-5) | 0.09 |
| 1,5-Diphenyl-3-pyrazolidone | 0.03 |

(in a state of fine-particle solid dispersion)

Third Layer (Green-Sensitive Emulsion Layer)

| | |
|---|---|
| The above silver chlorobromide emulsion E | 0.01 |
| Gelatin | 1.50 |
| Magenta coupler (ExM-2) | 0.197 |
| Reducing agent for color formation (I-78) | 0.211 |
| Solvent (Solv-1) | 0.80 |

Fourth Layer (Color-Mixing Inhibiting Layer)

| | |
|---|---|
| Gelatin | 0.77 |
| Color-mixing inhibitor (Cpd-7) | 0.08 |
| Solvent (Solv-1) | 0.14 |
| Solvent (Solv-3) | 0.05 |

-continued

| | |
|---|---|
| Solvent (Solv-4) | 0.14 |
| Solvent (Solv-5) | 0.06 |
| 1,5-Diphenyl-3-pyrazolidone | 0.02 |

(in a state of fine-particle solid dispersion)

Fifth Layer (Red-Sensitive Emulsion Layer)

| | |
|---|---|
| Silver chrolobromide emulsion F | 0.01 |

(cubes, a mixture of a large-size emulsion F having an average grain size of 0.10 μm, and a small-size emulsion F having an average grain size of 0.08 μm (1:4 in terms of mol of silver). The deviation coefficients of the grain size distributions were 0.09 and 0.11, respectively, and each emulsion had 0.8 mol % of silver bromide locally contained in part of the grain surface whose substrate was made up of silver chloride. The chemical ripening of this emulsion was carried out with a sulfur sensitizer and a gold sensitizer being added.)

| | |
|---|---|
| Gelatin | 1.50 |
| Cyan coupler (ExC-2) | 0.223 |
| Reducing agent for color formation (I-78) | 0.211 |
| Solvent (Solv-1) | 0.80 |

Sixth Layer (Ultraviolet Absorbing Layer)

| | |
|---|---|
| Gelatin | 0.64 |
| Ultraviolet absorbing agent (UV-1) | 0.39 |
| Color image stabilizer (Cpd-8) | 0.05 |
| Solvent (Solv-6) | 0.05 |

Seventh Layer (Protective Layer)

| | |
|---|---|
| Gelatin | 1.01 |
| Acryl-modified copolymer of polyvinyl alcohol (modification degree: 17%) | 0.04 |
| Liquid paraffin | 0.02 |
| Surface-active agent (Cpd-1) | 0.01 |

(ExY-2)

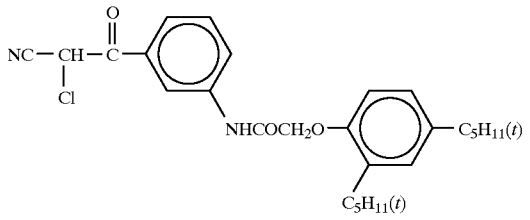

(ExC-2)

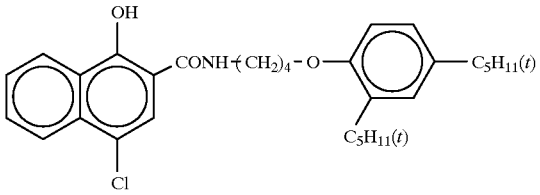

Samples (500) to (505) were prepared in the same manner as in Sample (500), except that instead of the coupler and the reducing agent for color formation, which were used in Sample (500), the coupler and the reducing agent for color formation, shown in Table 5, were used, in the same molar amounts.

By using an FWH-type sensitometer (color temperature of the light source: 3,200° K.), manufactured by Fuji Photo Film Co., Ltd., gradation exposure was given to all of the thus prepared-Samples through a three-color separation filter for sensitometry.

The thus exposed Samples were processed with the following processing solutions in the following processing steps:

Processing Steps I

| Processing step | Temperature | Time |
|---|---|---|
| Development | 40° C. | 40 sec |
| Rinse | room temperature | 45 sec |
| Alkali treatment | room temperature | 30 sec |

Developing Solution

| | |
|---|---|
| Water | 600 ml |
| Potassium phosphate | 40 g |
| KCl | 5 g |
| Hydroxylethylidene-1,1-diphosphonic acid (30%) | 4 ml |
| $H_2O_2$ | 10 ml |
| Water to make | 1,000 ml |
| pH (at 25° C. by using potassium hydroxide) | 11.5 |

The rinsing solution and the alkali treatment solution used in the Example 1 were used.

The maximum color density (Dmax) parts of magenta color part and cyan color part of the processed Samples were respectively measured using green light and red light. The results are shown in Table 5.

Using an FWH-type sensitometer (color temperature of the light source: 3,200° K.), manufactured by Fuji Photo Film Co., Ltd., exposure was given to the thus prepared Samples (500) to (505) with red light so as to obtain a cyan density of 0.5.

For the thus exposed Samples, the processing was carried out in the same manner as described above.

Reflection spectrum of each processed samples was measured, and the maximum absorption wavelength (λmax) of cyan color was read from the spectrum. The results are shown in Table 5.

TABLE 5

| Sample No. | Reducing agent for color formation | Magenta coupler | Cyan coupler | Magenta Dmax | Cyan Dmax | Cyan λmax | Remarks |
|---|---|---|---|---|---|---|---|
| 500 | I - 78 | ExM-2 | ExC-2 | 0.48 | 0.75 | 561 | Comparative example |
| 501 | " | C-10 | N-19 | 2.35 | 1.92 | 618 | This invention |
| 502 | " | C-7 | N-20 | 1.90 | 1.85 | 617 | This invention |
| 503 | I - 63 | ExM-2 | ExC-2 | 0.38 | 0.85 | 626 | Comparative example |
| 504 | " | C-10 | N-19 | 1.95 | 1.96 | 638 | This invention |
| 505 | " | C-7 | N-20 | 1.80 | 1.97 | 645 | This invention |

As is apparent from the results shown in Table 5, it can be understood that, even when a multi-layer light-sensitive material that had a small amount of coated silver was used, a phenol coupler for use in the present invention showed a higher magenta color density than a phenol coupler for comparison. Further, in comparison with the use of comparative naphthol couplers, when naphthol couplers for use in the present invention were used, the wavelength of the maximum absorption was present in a longer-wavelength region and a higher cyan color density was exhibited.

According to the present invention, by combining yellow couplers, magenta couplers, and cyan couplers shown, for example, in the present Examples, three colors: yellow, magenta, and cyan, can be formed successfully, with excellent color reproducibility and color-forming property. Further, use of the system of the present invention can provide a full-color light-sensitive material.

Having described our invention as related to the present embodiments, it is our intention that the invention not be limited by any of the details of the description, unless otherwise specified, but rather be construed broadly within its spirit and scope as set out in the accompanying claims.

What we claim is:

1. A silver halide color photographic light-sensitive material having at least one photographic constitutional layer including at least one silver halide emulsion layer on a support, wherein in the same or different photographic constitutional layers are contained at least one reducing agent for color formation represented by formula (I), and at least one dye-forming coupler represented by formula (II):

$$R^{11}—NH—NH—X—R^{12} \qquad \text{Formula (I)}$$

wherein, in formula (I), $R^{11}$ represents an aryl group or a heterocyclic group; $R^{12}$ represents an alkyl group, an alkenyl group, an alkynyl group, an aryl group, or a heterocyclic group; and X represents a group selected from the group consisting of $—SO_2—$, —CO—, —COCO—, —CO—O—, —CO—N($R^{13}$)—, —COCO—O—, —COCO—N($R^{13}$)—, and $—SO_2—N(R^{13})—$, in which $R^{13}$ represents a hydrogen atom or a group as defined for $R^{12}$:

Formula (II)

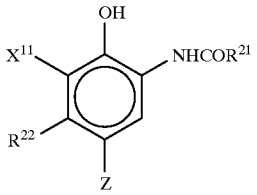

wherein, in formula (II), $R^{21}$ represents an aliphatic group, an aromatic group, a heterocyclic group, an aromatic amino group, or a heterocyclic amino group; $R^{22}$ represents an acylamino group; $X^{11}$ represents a hydrogen atom, a halogen atom, or an aliphatic group, an aromatic group, or an acylamino group; Z represents a hydrogen atom or a group capable of being split off upon oxidation coupling with a reducing agent for color formation; $R^{22}$ and $X^{11}$ may bond together to form a 5- to 7-membered nitrogen-containing heterocyclic ring; and one of $R^{21}$, $R^{22}$, $X^{11}$, and Z may serve to form a dimer coupler or a higher polymer coupler.

2. The silver halide color photographic light-sensitive material as claimed in claim 1, wherein the reducing agent for color formation represented by formula (I) is a compound represented by formula (IV-a):

$$R^{11}—NH—NH—SO_2—R^{12} \qquad \text{Formula (IV-a)}$$

wherein, in formula (IV-a), $R^{11}$ represents an aryl group or a heterocyclic group, and $R^{12}$ represents an alkyl group, an alkenyl group, an alkynyl group, an aryl group, or a heterocyclic group.

3. The silver halide color photographic light-sensitive material as claimed in claim 1, wherein the reducing agent for color formation represented by formula (I) is a compound represented by formula (IV-b):

$$R^{11}—NHNH—X^{11}—R^{12} \qquad \text{Formula (IV-b)}$$

wherein, in formula (IV-b), $X^{11}$ represents —CO— or —CON($R^{13}$) and $R^{11}$, $R^{12}$ and $R^{13}$ each have the same meanings as defined in formula (I).

4. The silver halide color photographic light-sensitive material as claimed in claim 1, wherein the reducing agent for color formation represented by formula (I) is a compound represented by formula (V):

Formula (V)

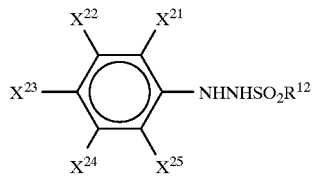

wherein, in formula (V), $R^{12}$ represents an alkyl group or a heterocyclic group; $X^{21}$, $X^{23}$, and $X^{25}$ each represent a hydrogen atom, a nitro group, a cyano group, an alkylsulfonyl group, an arylsulfonyl group, an alkylsulfinyl group, an arylsulfinyl group, a sulfamoyl group, a carbamoyl group, an alkoxycarbonyl group, an aryloxycabonyl group, an acyl group, or a trifluoromethyl group; and $X^{22}$ and $X^{24}$ each represent a hydrogen atom, a nitro group, a cyano group, an alkylsulfonyl group, an arylsulfonyl group, an alkylsulfinyl group, an arylsulfinyl group, a sulfamoyl group, a carbamoyl group, an alkoxycarbonyl group, an aryloxycarbonyl group, an acyl group, a trifluoromethyl group, a halogen atom, an acyloxy group, or an acylthio group, with the proviso that the sum of the Hammett $\sigma_p$ values of $X^{21}$, $X^{23}$, and $X^{25}$, and the Hammett $\sigma_m$ values of $X^{22}$ and $X^{24}$, is 1.5 or more.

5. The silver halide color photographic light-sensitive material as claimed in claim 1, wherein the coupler represented by formula (II) is a coupler represented by formula (VII):

Formula (VII)

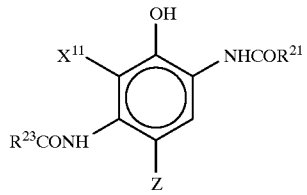

wherein, in formula (VII), $R^{23}$ represents an alkyl group or an aryl group; and $R^{21}$, $X^{11}$, and Z each have the same meanings as defined in formula (II).

6. The silver halide color photographic light-sensitive material as claimed in claim 5, wherein, in formula (VII), $R^{21}$ represents an alkyl group or an aryl group; $R^{23}$ represents an alkyl group or an aryl group; $X^{11}$ represents a hydrogen atom, an alkyl group, an alkenyl group, an aralkyl group, or an acylamino group; or $X^{11}$ and $R^{23}$ may bond together to form a 5- to 7-membered ring; and Z represents a hydrogen atom, a halogen atom, or an aryloxy group.

7. The silver halide color photographic light-sensitive material as claimed in claim 1, wherein an amount of the reducing agent for color formation represented by formula (I) to be used is 0.01 to 10 mmol/$m^2$ in one color-forming layer.

8. The silver halide color photographic light-sensitive material as claimed in claim 1, wherein an amount of the dye-forming coupler represented by formula (II) to be used is 0.05 to 20 times, the amount of the reducing agent for color formation of the formula (I), which agent is present in the same color-forming layer, in terms of mol.

9. A silver halide color photographic light-sensitive material having at least one photographic constitutional layer including at least one silver halide emulsion layer on a support, wherein in the same or different photographic constitutional layers are contained at least one reducing agent for color formation represented by formula (I), and at least one dye-forming coupler represented by formula (III):

$$R^{11}—NH—NH—X—R^{12}$$ Formula (I)

wherein, in formula (I), $R^{11}$ represents an aryl group or a heterocyclic group; $R^{12}$ represents an alkyl group, an alkenyl group, an alkynyl group, an aryl group, or a heterocyclic group; and X represents a group selected from the group consisting of $—SO_2—$, —CO—, —COCO—, —CO—O—, —CO—N($R^{13}$)—, —COCO—O—, —COCO—N($R^{13}$)—, and $—SO_2—N(R^{13})—$, in which $R^{13}$ represents a hydrogen atom or a group as defined for $R^{12}$, Formula (III)

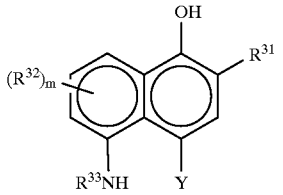

wherein, in formula (III), $R^{31}$ represents $—CONR^{34}R^{35}$, $—NHCOR^{34}$, $—NHCOOR^{36}$, $—NHSO_2R^{36}$, or $—NHCONR^{34}R^{35}$, in which $R^{34}$ and $R^{35}$, which are the same or different, each independently represent a hydrogen atom, an aliphatic group, an aromatic group, or a heterocyclic group; and $R^{36}$ represents an aliphatic group, an aromatic group, or a heterocyclic group; $R^{32}$ represents a group substitutable onto a naphthol ring; m is an integer of 0 to 3; $R^{33}$ represents an acyl group or an oxycarbonyl group; and Y represents a hydrogen atom or a group capable of being split off upon oxidation coupling with a reducing agent for color formation, and when m is 2 or more, $R^{32}$ s may be the same or different, or they may bond together to form a condensed ring; and $R^{32}$ and $R^{33}$, or $R^{33}$ and Y, may bond together to form a ring.

10. The silver halide color photographic light-sensitive material as claimed in claim 9, wherein the reducing agent for color formation represented by formula (I) is a compound represented by formula (IV-a):

$$R^{11}—NH—NH—SO_2—R^{12}$$ Formula (IV-a)

wherein, in formula (IV-a), $R^{11}$ represents an aryl group or a heterocyclic group, and $R^{12}$ represents an alkyl group, an alkenyl group, an alkynyl group, an aryl group, or a heterocyclic group.

11. The silver halide color photographic light-sensitive material as claimed in claim 9, wherein the reducing agent for color formation represented by formula (I) is a compound represented by formula (IV-b):

$$R^{11}—NHNH—X^{11}—R^{12}$$ Formula (IV-b)

wherein, in formula (IV-b), $X^{11}$ represents —CO— or $—CON(R^{13})—$; and $R^{11}$, $R^{12}$ and $R^{13}$ each have the same meanings as defined in formula (I).

12. The silver halide color photographic light-sensitive material as claimed in claim 9, wherein the reducing agent for color formation represented by formula (I) is a compound represented by formula (V):

Formula (V)

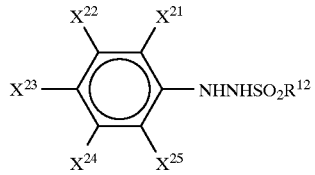

wherein, in formula (V), $R^{12}$ represents an alkyl group or a heterocyclic group; $X^{21}$, $X^{23}$, and $X^{25}$ each represent a hydrogen atom, a nitro group, a cyano group, an alkylsulfonyl group, an arylsulfonyl group, an alkylsulfinyl group, an arylsulfinyl group, a sulfamoyl group, a carbamoyl group, an alkoxycarbonyl group, an aryloxycabonyl group, an acyl group, or a trifluoromethyl group; and $X^{22}$ and $X^{24}$ each represent a hydrogen atom, a nitro group, a cyano group, an alkylsulfonyl group, an arylsulfonyl group, an alkylsulfinyl group, an arylsulfinyl group, a sulfamoyl group, a carbamoyl group, an alkoxycarbonyl group, an aryloxycarbonyl group, an acyl group, a trifluoromethyl group, a halogen atom, an acyloxy group, or an acylthio group, with the proviso that the sum of the Hammett $\sigma_p$ values of $X^{21}$, $X^{23}$, and $X^{25}$, and the Hammett $\sigma_m$ values of $X^{22}$ and $X^{24}$, is 1.5 or more.

13. The silver halide color photographic light-sensitive material as claimed in claim 9, wherein $R^{33}$ in formula (III) represents an aliphatic or aromatic acyl group, or an oxycarbonyl group.

14. The silver halide color photographic light-sensitive material as claimed in claim 9, wherein $R^{31}$ in formula (III) represents $—CONR^{34}R^{35}$.

15. The silver halide color photographic light-sensitive material as claimed in claim 9, wherein m in formula (III) is 0.

16. The silver halide color photographic light-sensitive material as claimed in claim 9, wherein $R^{32}$ in formula (III) represents a halogen atom, an aliphatic group, a carbonamido group, or a sulfonamido group.

17. The silver halide color photographic light-sensitive material as claimed in claim 9, wherein Y in formula (III) represents a hydrogen atom, a halogen atom, or an aromatic oxy group.

18. The silver halide color photographic light-sensitive material as claimed in claim 9, wherein an amount of the reducing agent for color formation represented by formula (I) to be used is 0.01 to 10 mmol/$m^2$ in one color-forming layer.

19. The silver halide color photographic light-sensitive material as claimed in claim 9, wherein an amount of the dye-forming coupler represented by formula (III) to be used is 0.05 to 20 times, the amount of the reducing agent for color formation of the formula (I), which agent is present in the same color-forming layer, in terms of mol.

20. The silver halide color photographic light-sensitive material as claimed in claim 3, wherein $X^{11}$ is —CON($R^{13}$)—.

21. The silver halide color photographic light-sensitive material as claimed in claim 11, wherein $X^{11}$ is —CON$R^{13}$)—.

22. A method of image formation comprising forming a magenta image by using a reducing agent for color formation of formula (I) and a dye-forming coupler of formula (II):

$R^{11}$—NH—NH—X—$R^{12}$ Formula (I)

wherein, in formula (I), $R^{11}$ represents an aryl group or a heterocyclic group; $R^{12}$ represents an alkyl group, an alkenyl group, an alkynyl group, an aryl group, or a heterocyclic group; and X represents a group selected from the group consisting of —$SO_2$—, —CO—, —COCO—, —CO—O—, —CO—N($R^{13}$)—, —COCO—O—, —COCO—N($R^{13}$)—, and —$SO_2$—N($R^{13}$)—, in which $R^{13}$ represents a hydrogen atom or a group as defined for $R^{12}$:

Formula (II)

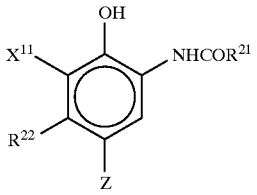

wherein, in formula (II), $R^{21}$ represents an aliphatic group, an aromatic group, a heterocyclic group, an aromatic amino group, or a heterocyclic amino group; $R^{22}$ represents an acylamino group; $X^{11}$ represents a hydrogen atom, a halogen atom, or an aliphatic group, an aromatic group, or an acylamino group; Z represents a hydrogen atom or a group capable of being split off upon oxidation coupling with a reducing agent for color formation; $R^{22}$ and $X^{11}$ may bond together to form a 5- to 7-membered nitrogen-containing heterocyclic ring; and one of $R^{21}$, $R^{22}$, $X^{11}$, and Z may serve to form a dimer coupler or a higher polymer coupler.

23. The method of image formation as claimed in claim 22 comprising subjecting the silver halide color photographic light-sensitive material as claimed in claim 1, which comprises at least one reducing agent for color formation of formula (I) and at least one dye-forming coupler of formula (II), to development, thereby forming a magenta image.

24. A method of image formation comprising forming a cyan image by using a reducing agent for color formation of formula (I) and a dye-forming coupler of formula (III):

R11—NH—NH—X—R12 Formula (I)

wherein, in formula (I), $R^{11}$ represents an aryl group or a heterocyclic group; $R^{12}$ represents an alkyl group, an alkenyl group, an alkynyl group, an aryl group, or a heterocyclic group; and X represents a group selected from the group consisting of —$SO_2$—, —CO—, —COCO—, —CO—O—, —CO—N($R^{13}$)—, —COCO—O—, —COCO—N($R^{13}$)—, and —$SO_2$—N($R^{13}$)—, in which $R^{13}$ represents a hydrogen atom or a group as defined for $R^{12}$:

Formula (III)

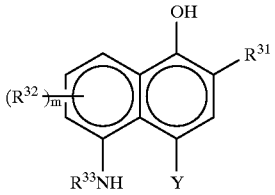

wherein, in formula (III), $R^{31}$ represents —CON$R^{34}R^{35}$, —NHCO$R^{34}$, —NHCOO$R^{36}$, —NH$SO_2R^{36}$, or —NHCON$R^{34}R^{35}$, in which $R^{34}$ and $R^{35}$, which are the same or different, each independently represent a hydrogen atom, an aliphatic group, an aromatic group, or a heterocyclic group; and $R^{36}$ represents an aliphatic group, an aromatic group, or a heterocyclic group; $R^{32}$ represents a group substitutable onto a naphthol ring; m is an integer of 0 to 3; $R^{33}$ represents an acyl group or an oxycarbonyl group; and Y represents a hydrogen atom or a group capable of being split off upon oxidation coupling with a reducing agent for color formation, and when m is 2 or more, $R^{32}$s may be the same or different, or they may bond together to form a condensed ring; and $R^{32}$ and $R^{33}$, or $R^{33}$ and Y, may bond together to form a ring.

25. The method of image formation as claimed in claim 24 comprising subjecting the silver halide color photographic light-sensitive material as claimed in claim 1, which comprises at least one reducing agent for color formation of formula (I) and at least one dye-forming coupler of formula (III), to development, thereby forming a cyan image.

* * * * *